US009927207B1

(12) United States Patent
Haugland

(10) Patent No.: US 9,927,207 B1
(45) Date of Patent: Mar. 27, 2018

(54) FIREARM STOCK SYSTEM

(71) Applicant: Dan Haugland, Phoenix, AZ (US)

(72) Inventor: Dan Haugland, Phoenix, AZ (US)

( * ) Notice: Subject to any disclaimer, the term of this patent is extended or adjusted under 35 U.S.C. 154(b) by 0 days.

(21) Appl. No.: 15/235,965

(22) Filed: Aug. 12, 2016

(51) Int. Cl.
*F41C 23/12* (2006.01)
*F41C 23/04* (2006.01)
*F41G 11/00* (2006.01)

(52) U.S. Cl.
CPC ..... *F41C 23/12* (2013.01); *F41C 23/04* (2013.01); *F41G 11/003* (2013.01)

(58) Field of Classification Search
CPC ..... F41A 35/00; F41A 35/06; F41C 23/00; F41C 23/10; F41C 23/12; F41C 23/14; F41C 23/20; F41C 23/04; F41C 23/06
USPC ..... 42/75.03, 71.02, 72, 73
See application file for complete search history.

(56) References Cited

U.S. PATENT DOCUMENTS 593,890 A * 11/1897 Houston ..... F41C 23/12 42/72
1,016,695 A * 2/1912 Kimmel ..... F41C 23/12 42/72
1,276,572 A * 8/1918 Rogers ..... F41C 23/12 42/148
1,315,215 A * 9/1919 Davidson ..... F41C 23/04 42/72
1,569,901 A * 1/1926 Virdin ..... F41C 23/00 42/72
1,877,016 A * 9/1932 Munson ..... F41C 23/12 15/104.165
2,374,621 A * 4/1945 Reising ..... F41C 23/04 42/72
3,570,162 A * 3/1971 Suddarth ..... F41C 23/04 42/72
3,685,194 A * 8/1972 Coon ..... F41C 23/12 42/72
3,798,818 A * 3/1974 Casull ..... F41C 23/12 42/72
4,291,482 A * 9/1981 Bresan ..... F41C 23/14 42/72
5,180,874 A * 1/1993 Troncoso, Jr. ..... F41C 33/001 42/71.02
5,956,879 A * 9/1999 Zerega ..... F41C 23/12 42/72
6,318,014 B1 * 11/2001 Porter ..... F41C 23/12 42/71.01
7,559,167 B1 * 7/2009 Moody ..... F41C 23/16 42/71.01
8,371,056 B1 * 2/2013 Baker ..... F41G 11/003 42/106
8,448,366 B2 * 5/2013 Faifer ..... F41C 23/04 42/71.01

(Continued)

*Primary Examiner* — Derrick R Morgan
(74) *Attorney, Agent, or Firm* — Booth Udell Fuller, PLC

(57) ABSTRACT

A firearm stock system and method are disclosed. The firearm stock system includes a rail clamp assembly cantileveredly coupled to a stock, whereby the rail clamp assembly is adapted to couple to a firearm and provide additional stability to a user when aiming and firing the firearm. The rail clamp assembly couples to an accessory rail of firearm. The stock may have a protrusion section to prevent obstruction of the user's hands. The stock and rail clamp assembly may be attached to accommodate right-handed shooting or left-handed shooting with the same stock.

17 Claims, 18 Drawing Sheets

(56) References Cited

U.S. PATENT DOCUMENTS

| | | | | |
|---|---|---|---|---|
| 2006/0064913 | A1* | 3/2006 | Gablowski | F41C 23/16 42/72 |
| 2008/0000132 | A1* | 1/2008 | Orvis | F41C 23/00 42/73 |
| 2009/0193702 | A1* | 8/2009 | Lin | F41C 23/16 42/72 |
| 2009/0282718 | A1* | 11/2009 | Bartley | F41C 23/12 42/75.03 |
| 2011/0088305 | A1* | 4/2011 | Oz | F41A 35/06 42/69.01 |
| 2011/0107644 | A1* | 5/2011 | Faifer | F41C 23/04 42/75.02 |
| 2012/0117844 | A1* | 5/2012 | Sweet | F41C 23/12 42/72 |
| 2012/0131829 | A1* | 5/2012 | Fistikchi | F41A 3/72 42/1.06 |
| 2012/0317854 | A1* | 12/2012 | Nierenberg | F41C 23/06 42/1.06 |
| 2014/0373414 | A1* | 12/2014 | Nierenberg | F41A 3/66 42/1.06 |
| 2015/0159977 | A1* | 6/2015 | Tseng | F41C 23/12 42/75.03 |
| 2016/0018184 | A1* | 1/2016 | Park | F41C 23/20 42/73 |
| 2016/0202016 | A1* | 7/2016 | Mather | F41C 23/14 42/73 |
| 2016/0231080 | A1* | 8/2016 | Holmes | F41C 23/16 |

* cited by examiner 47
48
44
49
42, 42B
46
43
45

47
44
42, 42B
46c
46
99
96
98
97
46b
43
46a
45

46
45
49
42, 42B

FIREARM STOCK SYSTEM

BACKGROUND

1. Technical Field

Aspects of this document relate generally to a removable firearm stock system for attaching a stock to a handgun or other firearm.

2. Background Art

A rifle generally has improved range and accuracy over a handgun for a variety of reasons. The buttstock or stock of a rifle offers a distinct advantage over handguns by providing increased stability when aiming and firing the rifle. Previous removable stocks used with handguns have been overly complicated and bulky. Many modern handguns now include an accessory rail system such as a Picatinny rail for mounting accessories to the handgun. A need exists to add a removable stock to a handgun or any other firearm with an accessory rail system to increase stability, comfort, and accuracy for a marksman using a handgun.

SUMMARY

Aspects of this document relate generally to a firearm stock system. These aspects may comprise, and implementations may include, one or more or all of the components and steps set forth in the appended claims, which are hereby incorporated by reference.

In a general aspect, a firearm stock system may include a stock having an engaging portion and a distal portion, and a rail clamp assembly including a clamping member configured to releasably couple to an accessory rail of a firearm, a rail clamp body having an engaging member configured to couple with at least a portion of the engaging portion of the stock, thereby cantileveredly supporting the distal portion of the stock, and a secondary accessory rail.

Particular implementations may include one or more or all of the following features.

The stock may include a protrusion portion positioned between the engaging portion and the distal portion of the stock, the protrusion portion having a length of 12 to 26 cm and being offset from a central axis of the engaging member by 2 to 6 cm.

The rail clamp assembly may releasably couple the accessory rail of the firearm without directly touching any other portion of the firearm, while no portion of the stock directly touches the firearm.

The distal portion of the stock may further include a buttplate having a top, bottom, and a length, the buttplate being configured to rest against a shoulder of a user when firing the firearm, and a column approximately parallel to a firing axis of the firearm, the column being coupled at approximately a midpoint between the top and bottom of the buttplate.

The clamping member may be configured to releasably couple to the accessory rail of the firearm in a first position and a second position axially rotated approximately 180° from the first position, whereby the firearm stock system is configured for right-handed firing of the firearm in the first position and left-handed firing of the firearm in the second position. The engaging member may also include an engaging recess that extends through the rail clamp body from a first face to a second face of the rail clamp body, thereby permitting coupling of the stock through the first face in the first position and through the second face in the second position.

The stock may include a folding buttstock.

In another aspect, a firearm stock system is disclosed that includes a stock having an engaging portion and a non-engaging portion, and a rail clamp assembly including a clamping member configured to releasably couple to an accessory rail of a firearm, a rail clamp body having an engaging recess configured to couple with the engaging portion of the stock, thereby cantileveredly supporting the non-engaging portion of the stock, and a secondary accessory rail.

Particular implementations may include one or more or all of the following features.

The non-engaging portion of the stock may have a length at least 15 times longer than the engaging portion of the stock.

No portion of the rail clamp assembly may be positioned above a barrel of the firearm.

The stock may have an asymmetrical shape along the longest axis of the stock when viewed from each of a plan view, right-side view, left-side view, front view, and rear view.

The clamping member may be configured to releasably couple to the accessory rail of the firearm in a first position and a second position axially rotated approximately 180° from the first position, whereby the firearm stock system is configured for left-handed firing of the firearm in the first position and right-handed firing of the firearm in the second position. The stock may also be ambidextrous and configured for use in the first position and the second position.

The rail clamp assembly may consist of no more than four machined pieces.

In still another aspect, a firearm stock system includes a stock having an engaging portion and a distal portion, and a rail clamp assembly including a clamping member configured to releasably couple to an accessory rail of a handgun, and a rail clamp body having an engaging member configured to couple with at least a portion of the engaging portion of the stock, thereby cantileveredly supporting the distal portion of the stock.

The stock may include a protrusion portion positioned between the engaging portion and a distal portion of the stock, wherein an axis of the engaging portion, an axis of the protrusion portion, and an axis of the distal portion are each offset 2-8 cm from each other and are each approximately parallel to each other.

The distal portion of the stock may be configured to couple to at least one of a removable buttstock, a collapsible buttstock, a stabilizing brace configured to couple to a forearm of a user, or a folding buttstock.

The stock may consist of a single piece of shaped metal having a curvilinear or rectilinear shape.

The engaging member may include an engaging recess that is configured to couple with the engaging portion at at least two angles within an axial rotation of ±90° from a position orthogonal to a vertical axis of the firearm.

The clamping member may be configured to releasably couple to the accessory rail of the firearm in a first position and a second position axially rotated approximately 180° from the first position, whereby the firearm stock system is configured for left-handed firing of the firearm in the first position and right-handed firing of the firearm in the second position. The stock may be ambidextrous and configured for use in the first position and the second position.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that he can be his own lexicographer if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This document features a firearm stock system. There are many features of a firearm stock system and method implementations disclosed herein, of which one, a plurality, or all features or steps may be used in any particular implementation.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Structure/Components

There are a variety of implementations of a firearm stock system. Implementations of a firearm stock system may include a stock having an engaging portion and a distal portion; and a rail clamp assembly including a clamping member configured to releasably couple to an accessory rail of a firearm; a rail clamp body having an engaging recess configured to couple with at least a portion of the engaging portion of the stock, thereby cantileveredly supporting the distal portion of the stock; and a secondary accessory rail.

Figure 1A:
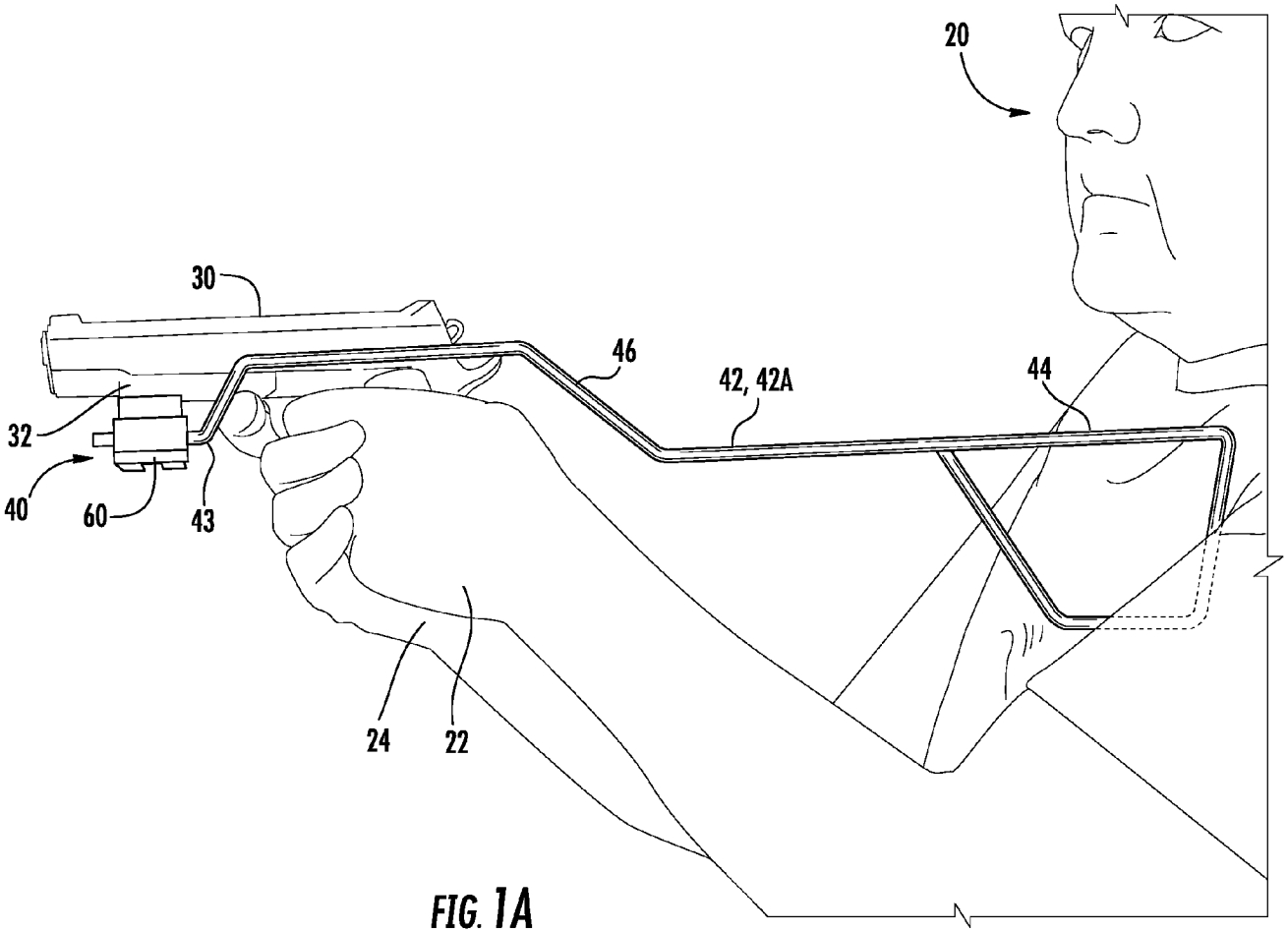
FIG. 1A is a perspective view of a firearm stock system according to an implementation.
Figure 1B:
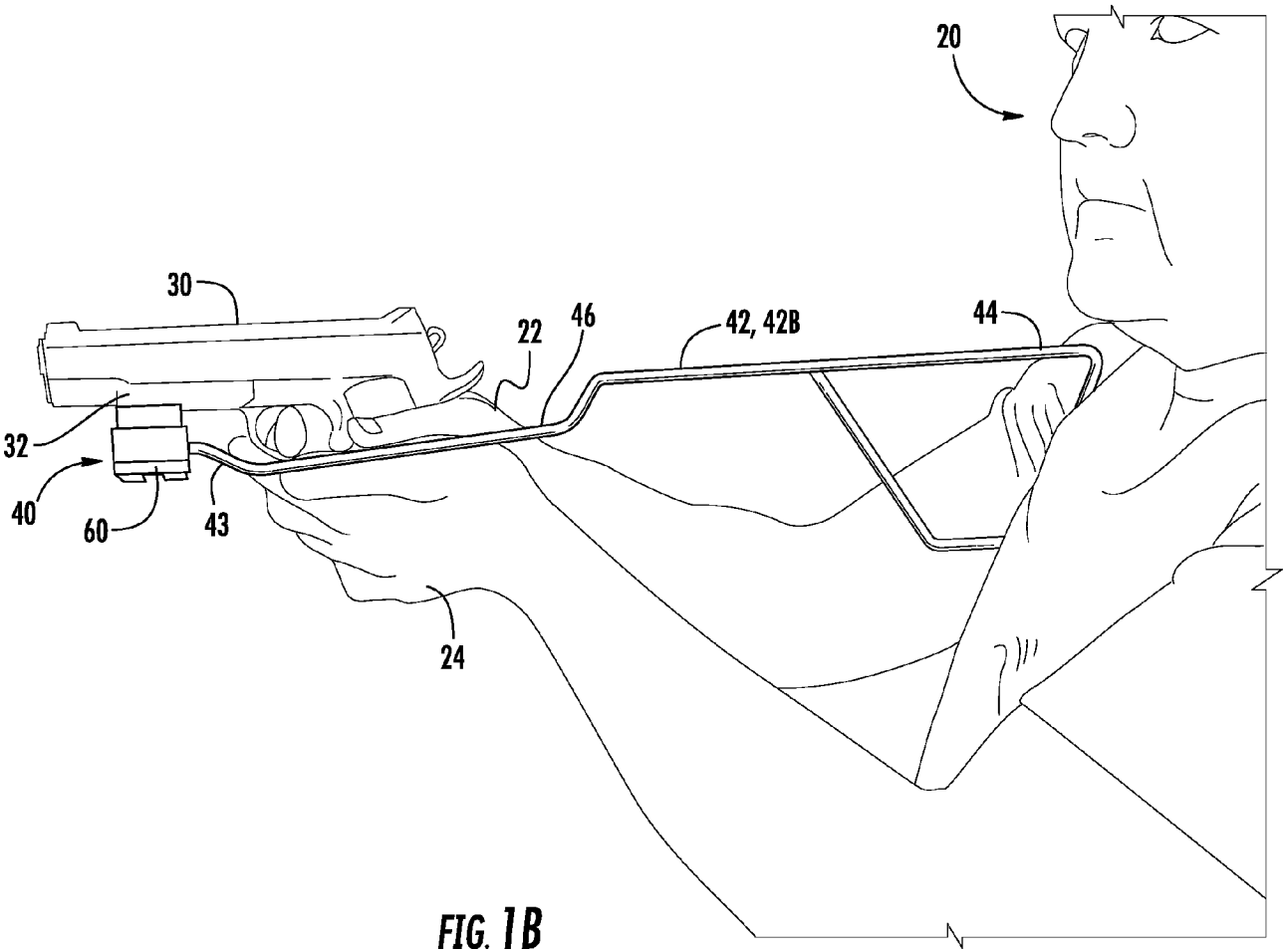
FIG. 1B is a perspective view of a firearm stock system according to another implementation.

For the exemplary purposes of this disclosure, FIGS. 1A and 1B depict perspective views of two different non-limiting implementations of a firearm stock system. According to some aspects, a firearm stock system 40 includes a rail clamp assembly 60 coupled to a stock 42, whereby the rail clamp assembly 60 is adapted to couple to a firearm 30 and provide additional stability to user 20 when aiming and firing the firearm 30. In some implementations, the rail clamp assembly 60 couples to an accessory rail 32 of firearm 30. In one or more implementations, the stock 42 includes engaging proximate portion 43, a protrusion 46, and a distal portion 44. Distal portion 44 of stock 42 may be configured to rest against a shoulder of user 20. User 20 may be a marksman, hunter, shooter, gun enthusiast, sportsman, or the like. In some implementations, firearm 30 is a handgun or other firearm capable of being fired with one hand (e.g., a pistol, handgun, revolver, AR-15 pistol, or the like). In alternative implementations, firearm 30 may be an AR-15 rifle, rifle, or shotgun for example.

Protrusion 46 of stock 42 may be bent or shaped away from firearm 30 to be positioned away from moving parts of the firearm 30 and/or a part of the hand or body of user 20. FIG. 1A, for example, depicts a non-limiting implementation of a stock 42 (here labeled stock 42A) where protrusion 46 is shaped away from firearm 30 to reduce or prevent obstruction to movement of the firearm 30 (e.g., a spent bullet casing and a slide moving when fired) and to the dominant hand 22 and/or the non-dominant hand 24 of user 20. Alternatively, FIG. 1B depicts a different non-limiting implementation of a stock 42 (here labeled stock 42B) where protrusion 46 is also shaped away from firearm 30 to reduce or prevent obstruction to movement of the firearm 30 and to the dominant hand 22 and/or the non-dominant hand 24 of user 20. Of particular note, FIG. 1A is depicted where the left hand of user 20 is the dominant hand 22 that is used as the trigger hand for firing the firearm 30. In contrast, FIG. 1B depicts with user 20 using his right hand as the trigger hand, demonstrating that the dominant hand 22 used as a trigger hand may be a left hand (as in FIG. 1A) or a right hand (as in FIG. 1B) depending on the user 20. While some users 20 may use their non-dominant hand 24 as a trigger hand, all drawings and descriptions herein assume that a user 20 will use the dominant hand 22 as a trigger hand. In one or more implementations, protrusion 46 is shaped and positioned so that user 20 may rest at least part of a finger or thumb on or against protrusion 46 while gripping firearm 30.

Figure 2A:
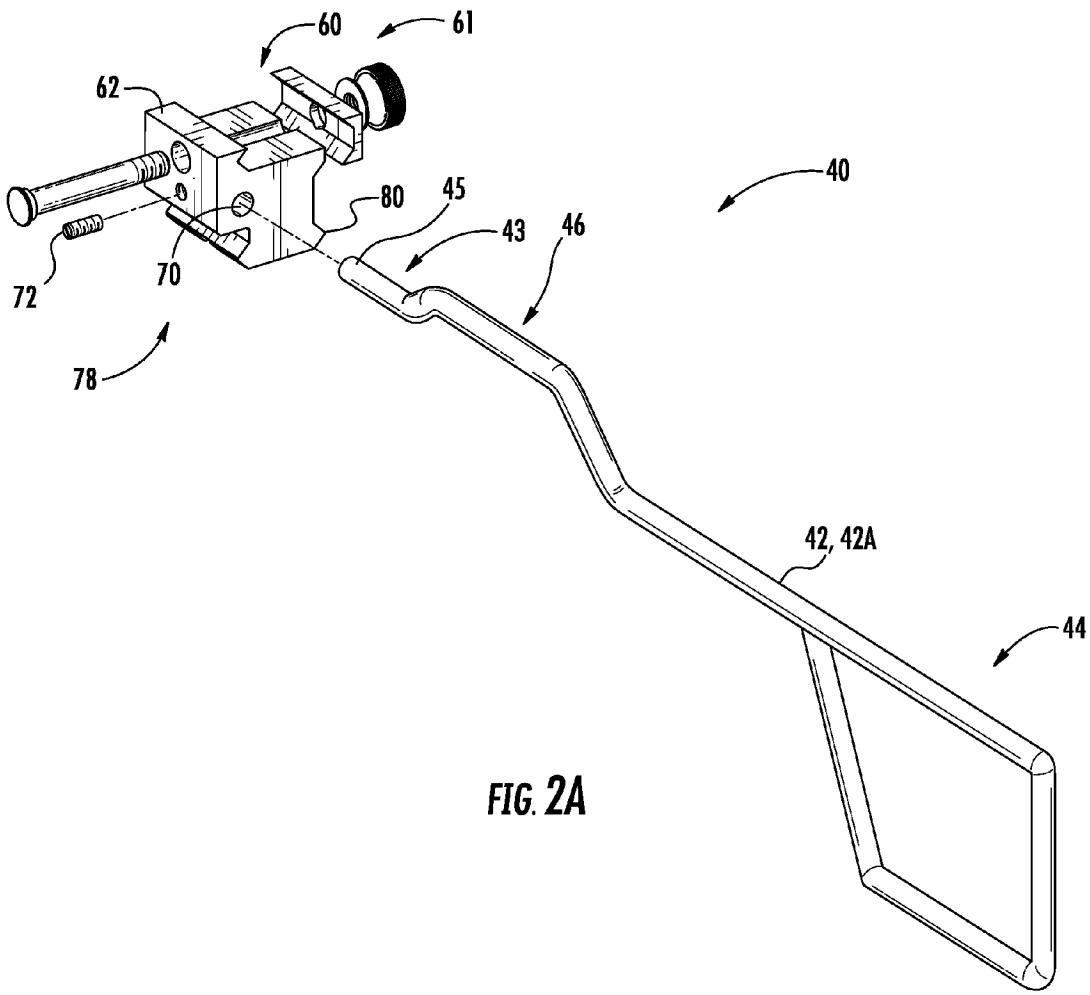
FIG. 2A is an exploded perspective view of a firearm stock system shown utilizing a stock according to the implementation of FIG. 1A.
Figure 2B:
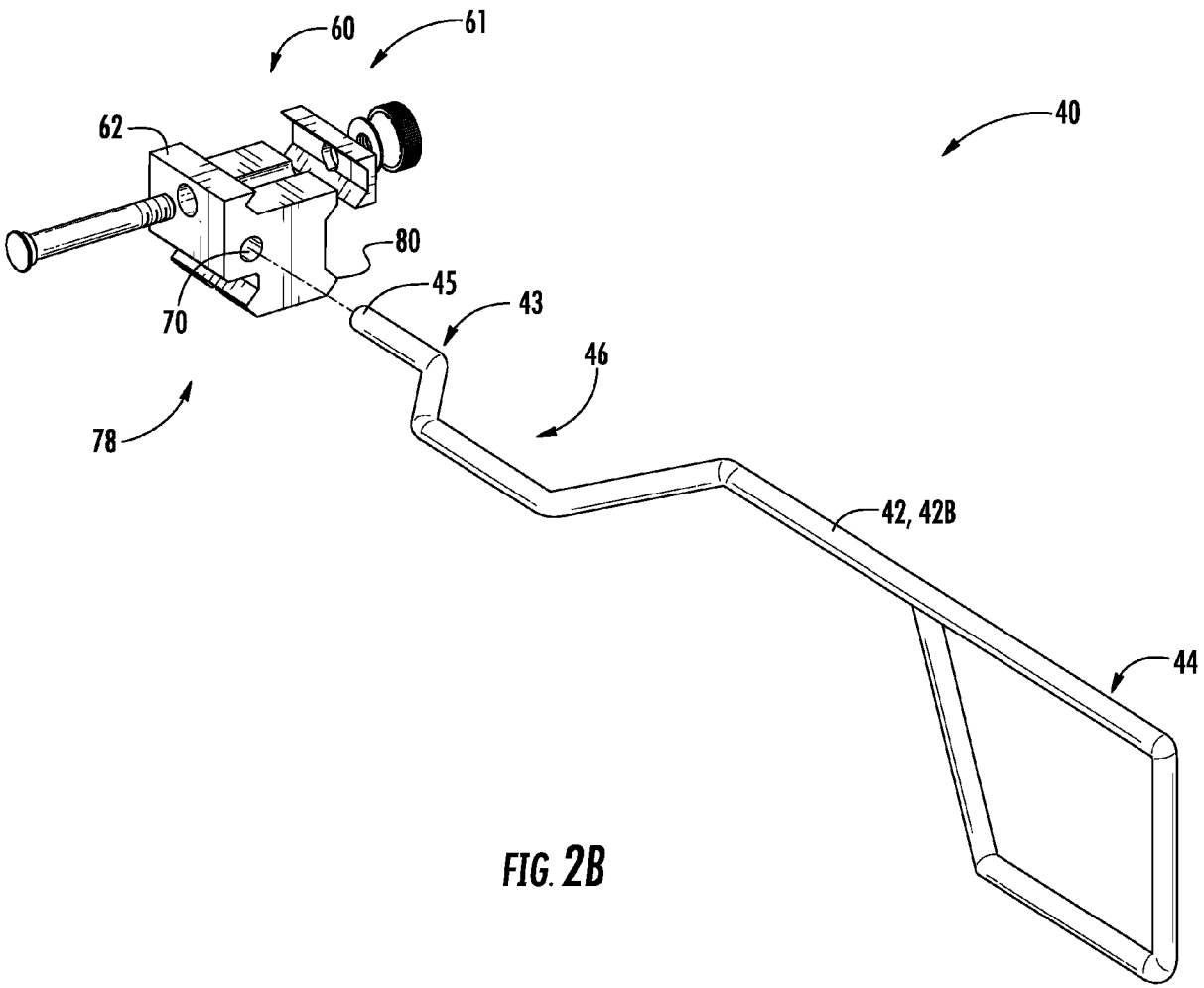
FIG. 2B is an exploded perspective view of a firearm stock system shown utilizing a stock according to the implementation of FIG. 1B.

FIGS. 2A and 2B depict exploded perspective views of non-limiting implementations of a firearm stock system 40. As depicted in FIGS. 2A and 2B, according to some aspects, rail clamp assembly 60 is configured to releasably couple to an accessory rail 32 of firearm 30. Accessory rail 32 is a rail interface system or rail accessory system adapted to couple accessory items (e.g., flashlight, laser sight, etc.) to a firearm. Accessory rail 32 includes a rail and/or bracket and may include transverse slots within the rail or bracket. Because rail clamp assembly 60 covers some or all of accessory rail 32 of firearm 30, rail clamp assembly 60 may also include a secondary accessory rail 80 in some implementations. Secondary accessory rail 80 is also a rail interface system similar to accessory rail 32 and may even be the same style or type. One or both of accessory rail 32 and secondary accessory rail 80 may be a tactical rail, Picatinny rail, Weaver rail, NATO accessory rail, a rail accessory system yet to be developed, or another standardized or proprietary rail interface system for firearms.

Rail clamp assembly 60 includes at least an engaging member for coupling with stock 42 (e.g., engaging recess 70) and a coupling member for releasably coupling the rail clamp assembly 60 onto the accessory rail 32 (e.g., clamping member 61). In some implementations, the rail clamp assembly 60 includes a clamping member 61, a block 62, an engaging recess 70, and optionally a secondary accessory rail 80. Clamping member 61 is a fastener or coupler configured to removably couple (e.g., clamp onto) the accessory rail 32, thereby providing a secure support for block 62 to hold stock 42. Clamping member 61 may be one of many varieties of fasteners or couplers adapted to couple with an accessory rail 32 of a firearm 30, is not limited to implementations depicted in FIGS. 2A and 2B, and may include other styles of clasps, clamps, quick-release fasteners, or other fasteners or couplers. Similarly, stock 42 may removably couple to block 62 using alternative coupling members other than the exemplary engaging recess 70 shown (e.g., plates and screws, sheathes, slots and rails, clamps, engagers, quick-release fasteners, magnetic couplers, or other fasteners or couplers).

In some implementations, stock 42 is configured to couple with rail clamp assembly 60 sufficient to provide the user 20 additional support when aiming and firing the firearm 30. Stock 42 may couple with rail clamp assembly 60 by inserting into engaging recess 70. Stock 42 may insert into engaging recess 70 in a fixed position or stock 42 may be axially rotated to any one or more positions ranging from 0-360°. Stock 42 may be one of many varieties of stocks (e.g., buttstocks, collapsible stock, removable stock, stabilizing brace, hinged or folding stock, or the like) adapted to assist a user 20 in firing firearm 30 by engaging the stock 42 with the shoulder or arm of the user 20, and is not limited to implementations depicted in FIGS. 2A and 2B. In some implementations, local laws defining rifles and minimum barrel lengths of rifles result in fewer regulatory restrictions for a stabilizing brace than a standard stock that rests against the shoulder. In some implementations, stock 42 may be a stabilizing brace (e.g., similar to a Sig Sauer® SB15 Pistol Stabilizing Brace) that securely couples to the forearm (e.g., with belts, hook-and-loop fasteners, etc.) rather than the shoulder of user 20.

In some implementations, stock 42 couples with rail clamp assembly 60 in a cantilevered manner where stock 42 is cantileveredly supported by an engaging portion 45 coupled to block 62, for example, by inserting into engaging recess 70. In some implementations, the only portion of the firearm stock system 40 to directly touch the firearm 30 is the rail clamp assembly 60 coupled to accessory rail 32, or preferably clamping member 61 coupled to accessory rail 32 as depicted in FIGS. 1A through 2B. Rail clamp assembly 60 may purposefully or inadvertently touch structures on firearm 30 near accessory rail 32 (e.g., within 1-3 cm of accessory rail 32), such as a trigger guard or the frame, but the support for the entire firearm stock system 40 is provided by the accessory rail 32. Rail clamp assembly 60 does not impede or block the user's 20 view of the sights of the firearm 30. In some implementations, no portion of the rail clamp assembly 60: extends behind the trigger or the trigger guard of firearm 30; extends in front of the muzzle of firearm 30; and/or extends above the base or top of the barrel of firearm 30. In some implementations, no portion of the stock 42 nearby firearm 30 (e.g., within 0-20 cm, 0-15 cm, 0-10 cm, or 0-7 cm of firearm 30) extends above the base or top of the barrel of firearm 30 (thus, some or all of distal portion 44 can be above the barrel if it is sufficiently far away from firearm 30).

According to some implementations, the stock 42 is supported in a cantilevered fashion where engaging portion 45 couples to block 62 by entering engaging recess 70. Engaging recess 70 and engaging portion 45 are depicted in FIGS. 2A and 2B as being cylindrical or curvilinear structures that securely mate to provide a fit sufficient to provide cantilevered support to the remainder of stock 42, but a person of ordinary skill in the art would appreciate that many alternative coupling and fastening mechanisms are sufficient to provide cantilevered support for stock 42 using the disclosed dimensions and materials for the stock 42, rail clamp assembly 60, and block 62. While being cantileveredly supported by block 62, some or all of stock 42 (e.g., distal portion 44 and/or protrusion 46) may be somewhat flexible or have some play in movement, but still be cantileveredly supported sufficient to increase the stability of aiming and firing firearm 30 for user 20.

Engaging portion 45 may be the entire length of proximate portion 43 or only a segment of proximate portion 43. The dimensions of block 62 and the length of engaging recess 70 determine the length of the engaging portion 45. Engaging recess 70 may bisect the entire length of block 62 and have a cross-sectional diameter of about 3 to 20 mm and a length between about 1 to 6 cm, 1.5 to 4 cm, or preferably about 2 to 3.5 cm. Engaging portion 45 may have a cross-sectional diameter of about 2 to 19 mm and a length between about 1 to 6 cm, 1.5 to 4 cm, or preferably about 2 to 3.5 cm. In some implementations, stock 42 may have an overall length (including the length of the engaging portion 45) between about 25 to 75 cm, 35 to 65 cm, 40 to 60 cm, or preferably about 48 to 58 cm. In alternative implementations, stock 42 may have a shortened length to be configured to attach a removable buttstock (e.g., see FIGS. 17 and 18) to distal portion 44, resulting in a stock 42 that may have an overall length between about 15 to 50 cm, 20 to 40 cm, 25 to 45 cm, or 25 to 35 cm. In some implementations, the non-engaging portion of the stock 42 (i.e., stock 42 excluding the engaging portion 45) has a length at least 5 times, but no more than 40 times, longer than the engaging portion 45 of the stock 42 (e.g., any integer between 5 and 40, including at least about 5, 10, 12, 15, 18, 20, 25, 32, or etc. times longer than engaging portion 45). For example: a stock 42 having a total length of 52.5 cm with an engaging portion 45 of 2.5 cm results in a 50 cm non-engaging portion of stock 42 that is 20 times longer than the engaging portion 45; or a stock 42 having a total length of 40 cm with an engaging portion 45 of 4 cm results in a 36 cm non-engaging portion of stock 42 that is 9 times longer than the engaging portion 45.

Figure 5A:
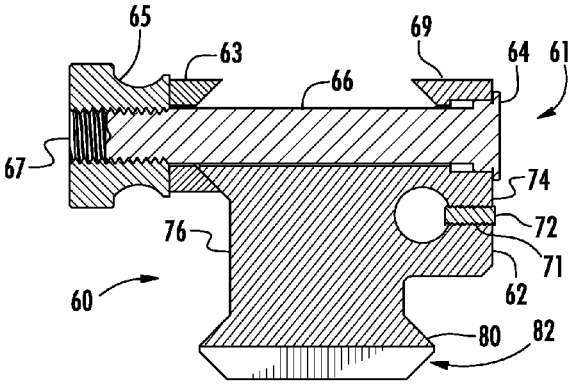
FIG. 5A is a cross-sectional view of a rail clamp assembly according to the implementation of FIG. 2A.
Figure 3B:
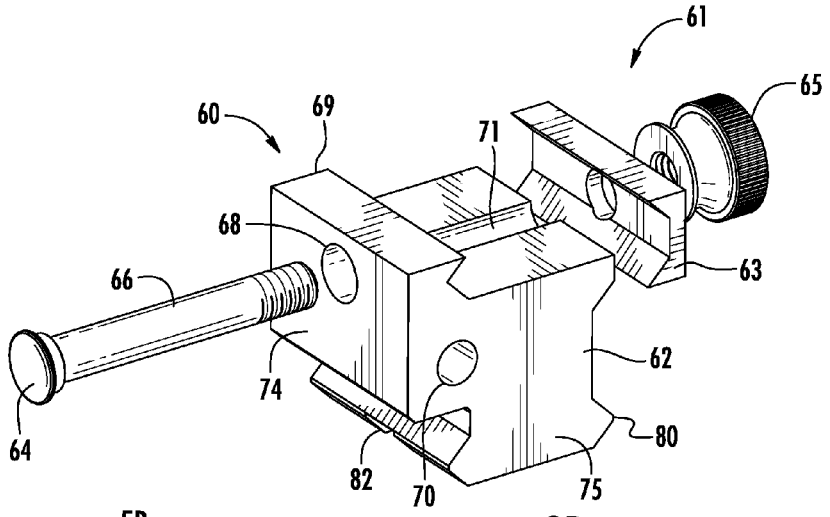
FIG. 3B is an exploded perspective view of a rail clamp assembly according to the implementation of FIG. 2B.
Figure 4B:
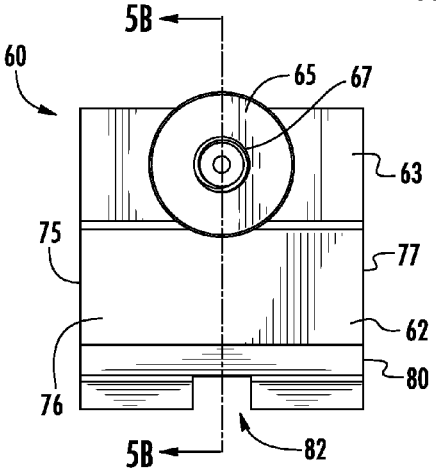
FIG. 4B is a side view of a rail clamp assembly according to the implementation of FIG. 2B.

As shown in the non-limiting implementation depicted in FIG. 2A, rail clamp assembly 60 may include a set screw 72 operable to help to affix stock 42 in the engaging recess 70. For example, set screw 72 can rotate within threaded set recess 71 (see FIGS. 3A and 5A) so that a portion of the set screw 72 protrudes into engaging recess 70. The set screw 72 can be loosened to allow some or all of the proximate portion 43 of stock 42 to enter into the engaging recess 70, and then the set screw 72 can be tightened until it contacts proximate portion 43 and helps affix stock 42 in place in the engaging recess 70. Although not shown in FIG. 2A, engaging portion 45 of stock 42 may have a flattened, keyed, depressed, hollowed, concave, beveled, or narrowed portion (either in one or more spots or around the entire axis of the wireform) configured to have set screw 72 seated within this portion when tightened in order to more securely hold stock 42 in place within engaging recess 70.

Figure 3A:
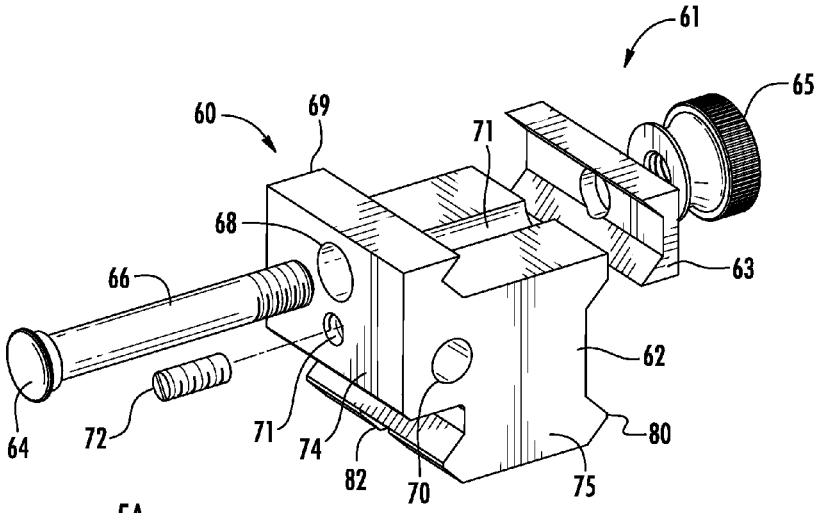
FIG. 3A is an exploded perspective view of a rail clamp assembly according to the implementation of FIG. 2A.
Figure 4A:
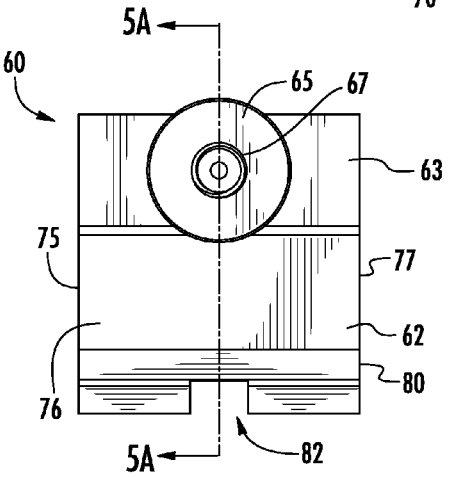
FIG. 4A is a side view of a rail clamp assembly according to the implementation of FIG. 2A.
Figure 5B:
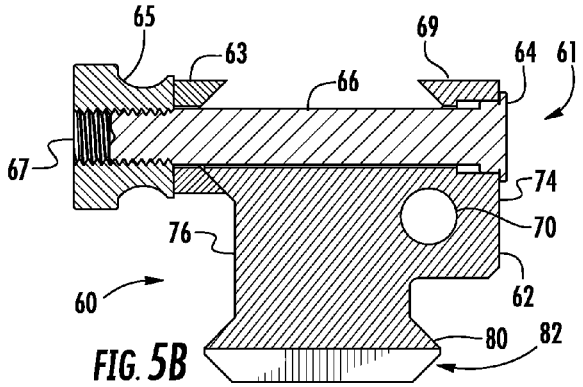
FIG. 5B is a cross-sectional view of a rail clamp assembly according to the implementation of FIG. 2B.

Referring to FIGS. 3A through 5B: FIGS. 3A and 3B depict exploded perspective views of a non-limiting implementations of rail clamp assembly 60; FIGS. 4A and 4B depict side views of non-limiting implementations of rail clamp assembly 60; and FIGS. 5A and 5B depict cross-sectional views of non-limiting implementations of rail clamp assembly 60. Rail clamp assembly 60 includes at least a means for clamping onto or coupling to accessory rail 32 and a means for cantileveredly holding and supporting stock 42. In some implementations, the rail clamp assembly 60 includes a clamping member 61, and a means for cantileveredly holding and supporting stock 42 (e.g., a block 62 and an engaging recess 70).

In certain implementations, the clamping member 61 includes at least an adjustable bracket 63 and a fixed bracket 69 sized and configured to releasably and securely couple to accessory rail 32. Clamping member 61 may also include a fastener or coupler including a bolt 64 having a threaded section 67 that mates with a knob 65 to adjustably position fixed bracket 69 and adjustable bracket 63 around accessory rail 32, thereby clamping (i.e., coupling or fastening) rail clamp assembly 60 onto accessory rail 32. Clamping member 61 may utilize bolt 64 having a shoulder that stops bolt 64 after shaft 66 has passed through bolt recess 68 so that knob 65 can threadedly couple to threaded section 67 of bolt 64, thereby adjustably applying pressure to adjustable bracket 63 and allowing secure coupling of clamping member 61 to accessory rail 32. Clamping member 61 is depicted in FIGS. 3A through 5B as having a fixed bracket 69 and an adjustable bracket 63, but a person of ordinary skill in the art would appreciate that many alternative coupling and fastening mechanisms are sufficient to removably couple, fasten, or clamp the rail clamp assembly 60 to accessory rail 32.

Figure 12:
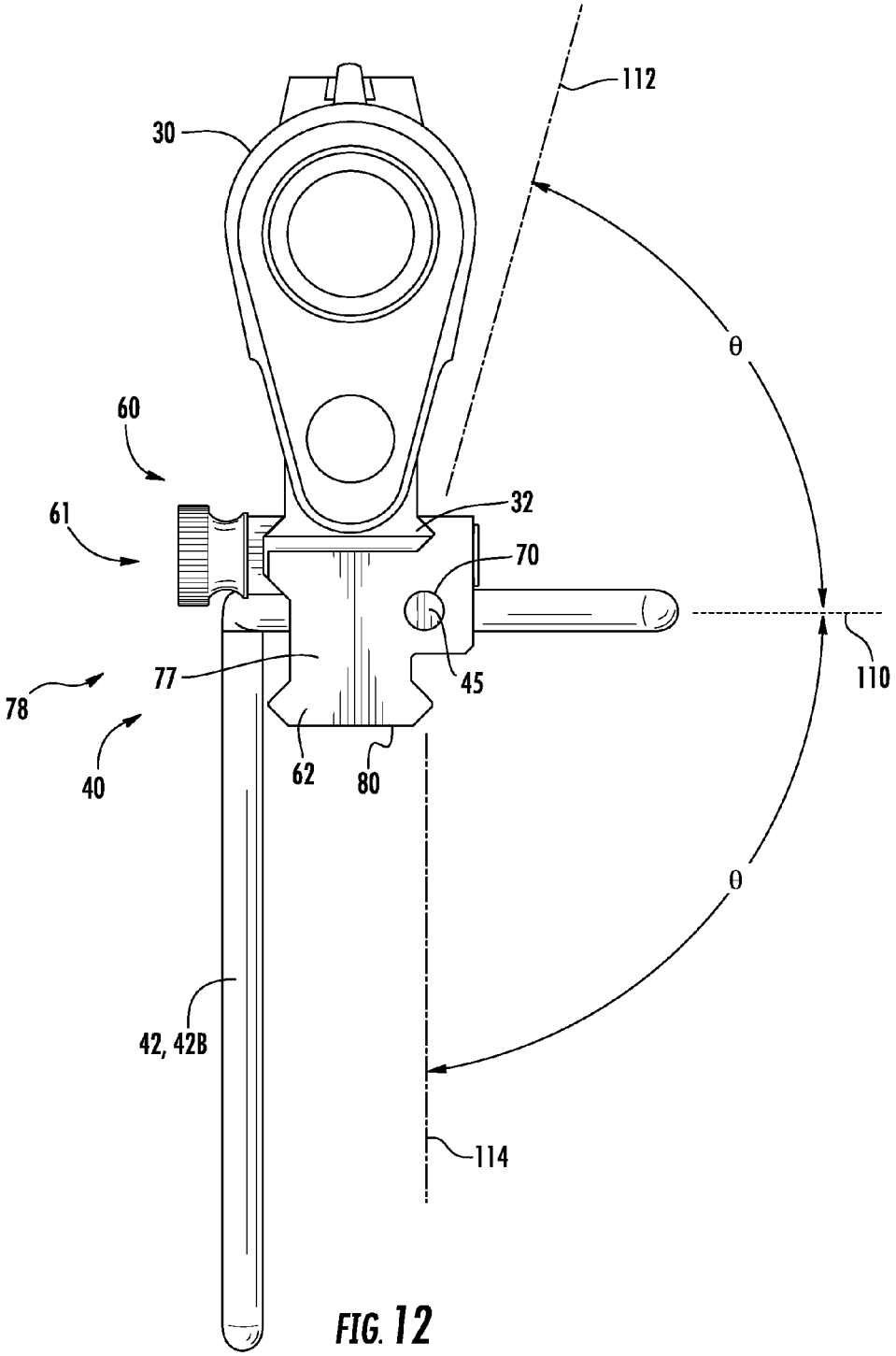
FIG. 12 is a front view of a firearm stock system.

In some implementations, shaft 66 of bolt 64 is configured to limit or reduce forward or rearward movement of rail clamp assembly 60 on accessory rail 32. Many accessory rails 32 have at least one transverse slot or groove positioned along the accessory rail 32. For example, a Picatinny rail uses a series of transverse slots 3 mm deep spaced 10 mm apart (from center to center) where the slot length (parallel to firing axis of firearm 30) is 5.23 mm, resulting in a rail section length of 4.77 mm. Secondary accessory rail 80 illustrates a transverse slot 82, which can be sized to be any of the disclosed rail interface systems or rail interface systems yet to be developed. While accessory rail 32 may have one or more transverse slots, none are depicted in FIG. 1A, 1B or 12 because the accessory rail is mostly obscured by the coupled rail clamp assembly 60. Bolt 64 and shaft 66 may have a diameter and be positioned (e.g., by placement of bolt recess 68 on block 62) such that shaft 66 engages with one or more sides of the transverse slot of accessory rail 32, thereby limiting the ability of rail clamp assembly 60 to slide forwards or backwards along accessory rail 32. In alternative implementations, a pin, cotter pin, latch, or other fastener instead of bolt 64 may be used to engage one or more sides of the transverse slot of accessory rail 32.

In certain implementations, structural or functional elements of rail clamp assembly 60 may be repositioned and still operate as described. For example, engaging recess 70 may be repositioned towards a right side portion or central portion of block 62. Bolt 64 and knob 65 may be reversed so that the knob 65 is proximate left face 74 rather than right face 76.

In some implementations, rail clamp assembly 60 includes a secondary accessory rail 80. Similar to accessory rail 32, secondary accessory rail 80 is a rail interface system or rail accessory system adapted to couple accessory items (e.g., flashlight, laser sight, etc.) to a firearm. Secondary accessory rail 80 includes a rail and/or bracket and may include one or more transverse slots 82 within the rail or bracket (as shown), or may omit the transverse slot(s) 82. Certain implementations may include secondary accessory rail 80 because rail clamp assembly 60 covers some or all of accessory rail 32. Secondary accessory rail 80 may be included on rail clamp assembly 60 for additional accessory options even when an accessory rail 32 still has usable space on accessory rail 32 when the rail clamp assembly 60 is securely coupled thereto. Although not depicted in the figures, secondary accessory rail 80 may be positioned: on a different surface of rail clamp assembly 60 (e.g., left face 74, rear face 75, right face 76, or front face 77, other faces for an alternatively shaped rail clamp assembly 60, etc.); or anywhere on stock 42 other than the engaging portion 45. Additionally, multiple secondary accessory rails 80 may be placed at various locations on the rail clamp assembly 60 and/or the stock 42 (also not shown). Secondary accessory rail 80 may be a tactical rail, Picatinny rail, Weaver rail, NATO accessory rail, a rail accessory system yet to be developed, or another standardized or proprietary rail interface system for firearms.

Figure 13:
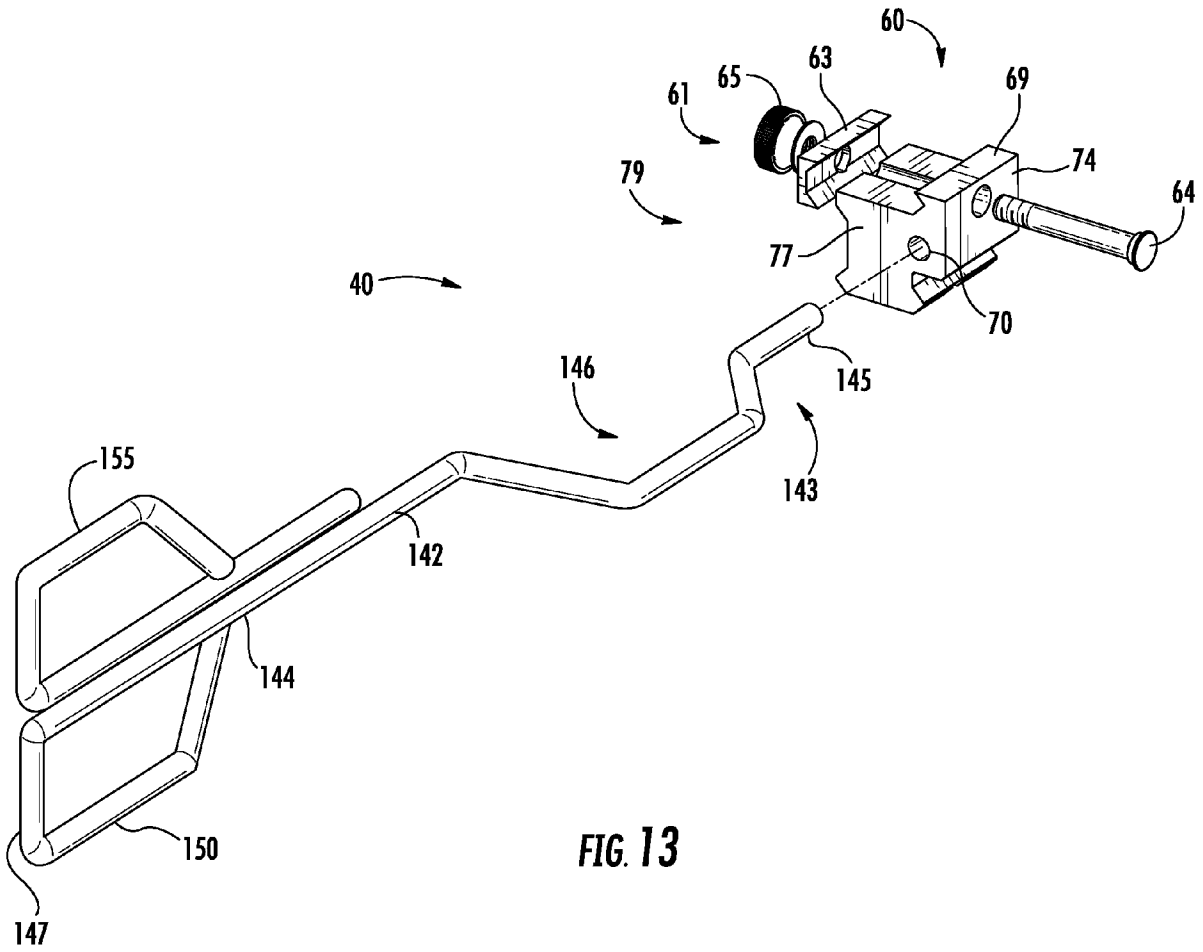
FIG. 13 is an exploded perspective view of a firearm stock system.

In some implementations, firearm stock system 40 can employ a single rail clamp assembly 60 that can be rotated by 180° to position the engaging recess 70 on the right side of the firearm 30 (from the perspective of user 20) rather than on the left side of firearm 30 (e.g., see FIG. 13). Position 79 labeled in FIG. 13 depicts an example of the engaging recess 70 being positioned on the right side of firearm 30 where, alternatively, position 78 labeled in FIGS. 2A and 2B depicts an example of the engaging recess 70 being positioned on the left side of firearm 30. Depending on the shape and function of the stock 42 used, each of position 78 and position 79 may be used to accommodate either a user 20 firing firearm 30: with a right hand (generally using a right shoulder or arm to brace stock 42); or with a left hand (generally using a left shoulder or arm to brace stock 42). In some implementations, rail clamp assembly 60 can be coupled to accessory rail 32 in position 78 with engaging recess 70 on the user's 20 right, or rail clamp assembly 60 can be rotated 180° and coupled to accessory rail 32 in a position 79 with engaging recess 70 on the user's 20 left. In some implementations, rail clamp assembly 60 has a generally cubic shape with four side faces: left face 74 (left' from a user's 20 perspective when holding firearm 30), rear face 75, right face 76 (right' from a user's 20 perspective when holding firearm 30), and front face 77. While in position 78, these four faces match their moniker (e.g., front face 77 is nearest the front of firearm 30, left face 74 is to the left of right face 76, and so forth). However, rail clamp assembly 60 can be rotated by 180° into position 79, which results in the left face 74 being on the right, the rear face 75 being in the front, the right face 76 being on the left, and the front face 77 being in the rear (e.g., as depicted in FIG. 13).

In some implementations stock 42 is configured to accommodate left-handed shooting while rail clamp assembly 60 is in position 78 (e.g., stock 42A in FIG. 2A). In other implementations stock 42 is configured to accommodate right-handed shooting while rail clamp assembly 60 is in position 78 (e.g., stock 42B in FIG. 2B). In further implementations stock 42 is configured to accommodate left-handed shooting while rail clamp assembly 60 is in position 79 (not shown, but see stock 42C in FIGS. 8A and 9A for non-limiting example). In still further implementations stock 42 is configured to accommodate right-handed shooting while rail clamp assembly 60 is in position 79 (not shown, but a mirror image of stock 42B shown in FIGS. 7B-9B is a non-limiting example). In some implementations, stock 42 has a modified shape to accommodate both firing positions (i.e., right-handed and left-handed firing) using a single stock 42 adapted to use in either position 78 or position 79 such that the stock 42 fits against the user's 20 shoulder in a similar fashion in both right and left-handed firing positions (see, ambidextrous stock depicted in FIGS. 13-16).

Figure 6A:
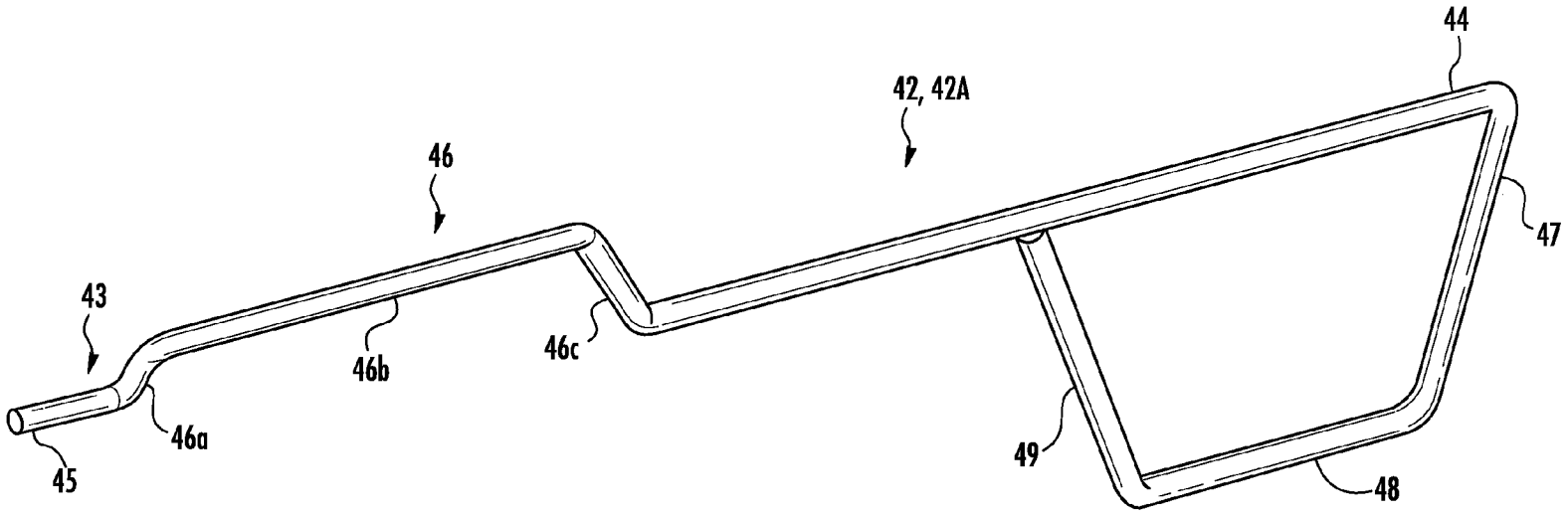
FIG. 6A is a perspective view of a stock according to the implementation of FIG. 1A.
Figure 9A:
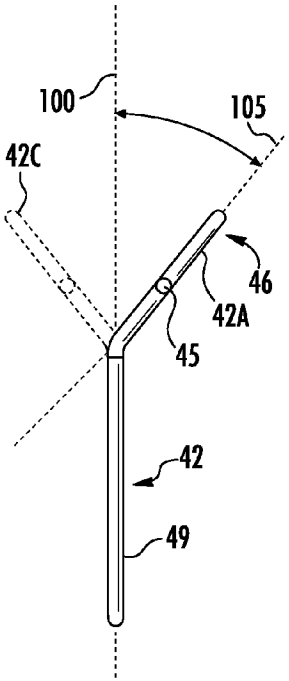
FIG. 9A is front view of a stock according to the implementation of FIG. 1A.
Figure 7A:
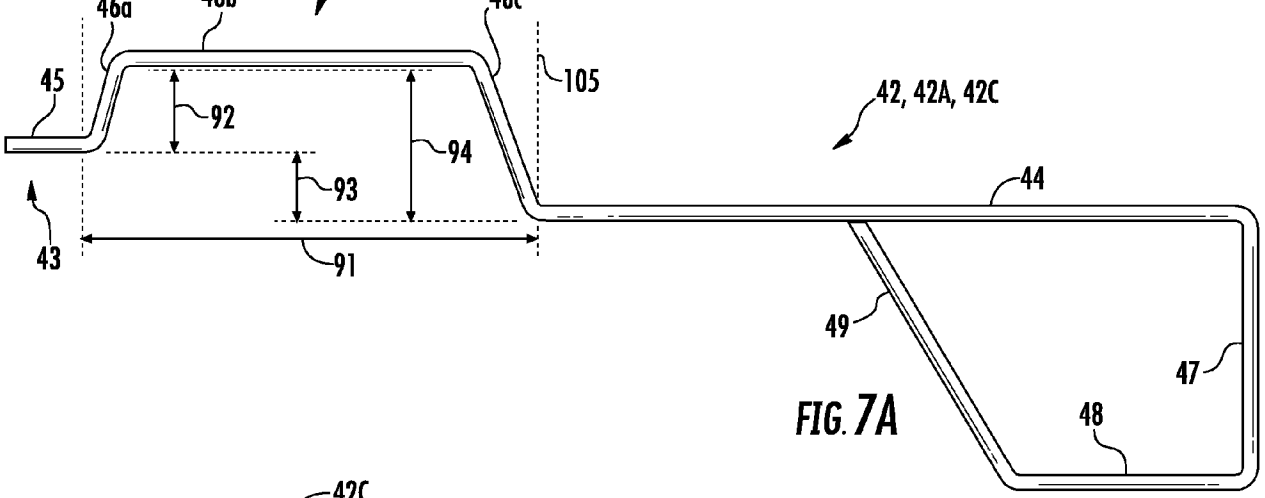
FIG. 7A is a side view of a stock according to the implementation of FIG. 1A.
Figure 8A:
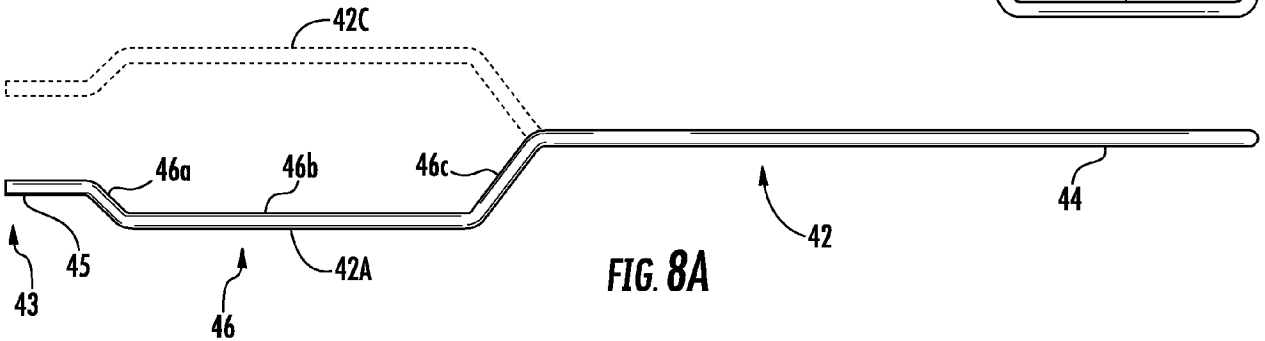
FIG. 8A is a plan view of a stock according to the implementation of FIG. 1A.

Referring to FIGS. 6A, 7A, 8A, and 9A: FIG. 6A depicts a perspective view of a non-limiting implementation of a stock 42; FIG. 7A depicts a side view of a non-limiting implementation of a stock 42; FIG. 8A depicts a plan view of a non-limiting implementation of a stock 42; and FIG. 9A depicts a front view of a non-limiting implementation of a stock 42. Stock 42 may have a curvilinear or rectilinear wireform construction of a metal, alloy, plastic, composite, or other suitable material. Stock 42 may include a proximate portion 43, protrusion 46, and distal portion 44. Proximate portion 43 includes at least an engaging portion 45. In the stock 42 depicted as stock 42A, protrusion 46 is offset from the engaging portion 45 (offset 92) and may also be offset from distal portion 44 (offset 94) as shown. Protrusion 46 may include multiple angles separating sections, such as sections 46*a*, 46*b*, and 46*c*. Alternatively, protrusion 46 may have other angular, curved, or irregular shapes sufficient to achieve the goals of not obstructing the user's 20 dominant hand 22 and/or non-dominant hand 24 when firing and providing sufficient support to distal portion 44 against user's 20 shoulder or arm when firing. Distal portion 44: includes at least a column, shaft, spar, post, bar, or the like; typically is approximately parallel to the firing axis of firearm 30; and transfers energy from firing the firearm 30 to user's 20 shoulder or arm. Near the distal-most section of distal portion 44 a buttplate 47 operates to rest against the shoulder of user 20 when aiming and firing firearm 30. Buttplate 47 can be a simple wireform structure as shown, or it can be larger and include padding and/or a conformal elongated surface to be more comfortable against user's 20 shoulder. Distal portion 44 may also include sections 48 and 49, for example, to provide greater structural stability to buttplate 47 and transfer energy from the column portion of distal portion 44 when firing firearm 30.

In some implementations, the protrusion 46 of stock 42 is tilted away from a vertical plane 100 (e.g., as shown with stock 42A) to avoid or limit contact with the dominant hand 22 and/or non-dominant hand 24 of user 20 when aiming and firing firearm 30. For example, stock 42A has protrusion 46 tilted and positioned along tilted plane 105, where tilted plane 105 intersects vertical plane 100 at an angle labeled Φ in FIG. 9A (with 0° starting at the top and rotating clockwise such that 90° is on the right and 270° is on the left of FIG. 9A). Where the angle Φ is not zero degrees, the offsets 92, 93, and 94 are measured along the tilted plane 105. Where the angle Φ equals zero degrees, the offsets 92, 93, and 94 are measured along the vertical plane 100 (because the tilted plane 105 is the same as the vertical plane 100 when the angle Φ equals zero).

Stock 42A is depicted in FIGS. 1A, 2A, 7A, 8A, and 9A as being configured to accommodate a user 20 firing firearm 30 where the dominant hand 22 (i.e., trigger hand as used herein) is the user's 20 left hand. Stock 42A configured for left-handed firing will result in the angle Φ being from about 1° to 179° measured from the top of the vertical plane 100 as the origin. In some implementations, the angle for stock 42A is between about 15° to 130°, 15° to 60°, 20° to 50°, 25° to 45°, or preferably 30° to 40°.

In certain implementations, a stock 42 is an exact or near mirror image of stock 42A, thereby being configured to accommodate a user 20 firing firearm 30 where the dominant hand 22 (i.e., trigger hand as used herein) is the user's 20 right hand. As denoted in dashed lines in FIGS. 8A and 9A, a right-handed firing stock 42C is a mirror image of stock 42A (dashed lines of stock 42C are omitted from FIG. 7A because they are entirely obscured by stock 42A). Stock 42C is configured for right-handed firing by positioning rail clamp assembly 60 in position 79 (or by using alternative implementations where engaging recess 70 is: on the right side of block 62, near right face 76, and/or otherwise positioned so protrusion 46 of stock 42C is positioned on the right side of firearm 30 from the user's 20 perspective). Thus, stock 42C configured for right-handed firing will result in the angle Φ being from about 181° to 359° measured from the top of the vertical plane 100 as the origin. In some implementations, the angle Φ for stock 42C is between about 230° to 345°, 300° to 345°, 310° to 340°, 315° to 335°, or preferably 320° to 330°.

In certain implementations, protrusion 46 of stock 42 is shaped so that no portion of the outermost section of protrusion 46 (e.g., section 46*b*) is positioned above the center axis of the barrel of firearm 30 when stock 42 is coupled to rail clamp assembly 60 at engaging recess 70. In some implementations, the angle Φ for stock 42C is between about 200° to 300°, 230° to 300°, 240° to 285°, or preferably 260° to 280°. In some implementations, the angle 1 for stock 42A is between about 60° to 160°, 60° to 130°, 75° to 120°, or preferably 80° to 100°.

In certain implementations, protrusion 46 of stock 42 is shaped so that no portion of the outermost section of protrusion 46 (e.g., section 46*b*) is positioned below a bottom-most portion of the trigger guard of firearm 30 when stock 42 is coupled to rail clamp assembly 60 at engaging recess 70. In some implementations, the angle Φ for stock 42C is between about 230° to 350°, 240° to 350°, 260° to 340°, 280° to 340°, or preferably 300° to 340°. In some implementations, the angle Φ for stock 42A is between about 10° to 130°, 10° to 120°, 20° to 100°, 20° to 80°, or preferably 20° to 60°.

In some implementations, protrusion 46 has a length 91, offset 92, offset 93, and offset 94 configured to avoid or limit contact with the dominant hand 22 and/or non-dominant hand 24 of user 20 when aiming and firing firearm 30. Length 91 is the overall length of protrusion 46 and may be about 10 to 30 cm, or preferably about 15 to 25 cm. Offset 92 is the offset between the axis of the engaging portion 45 (which is the same axis as the corresponding engaging recess 70 when fitted in block 62) and the outermost section of protrusion 46 (e.g., section 46*b* in FIG. 7A). Offset 92 may be about 1 to 10 cm, or preferably about 2 to 5 cm. Offset 93 is the offset between the axis of the engaging portion 45 and the axis of the column or main portion of distal portion 44, which is typically parallel to the firing axis (e.g., the barrel) of firearm 30. Offset 93 may be about 1 to 10 cm, or preferably about 2 to 4 cm. Offset 94 is the offset between the outermost section of protrusion 46 (e.g., section 46*b* in FIG. 7A) and the axis of the column or main portion of distal portion 44. Offset 94 may be about 2 to 15 cm, or preferably about 4 to 9 cm.

Figure 6B:
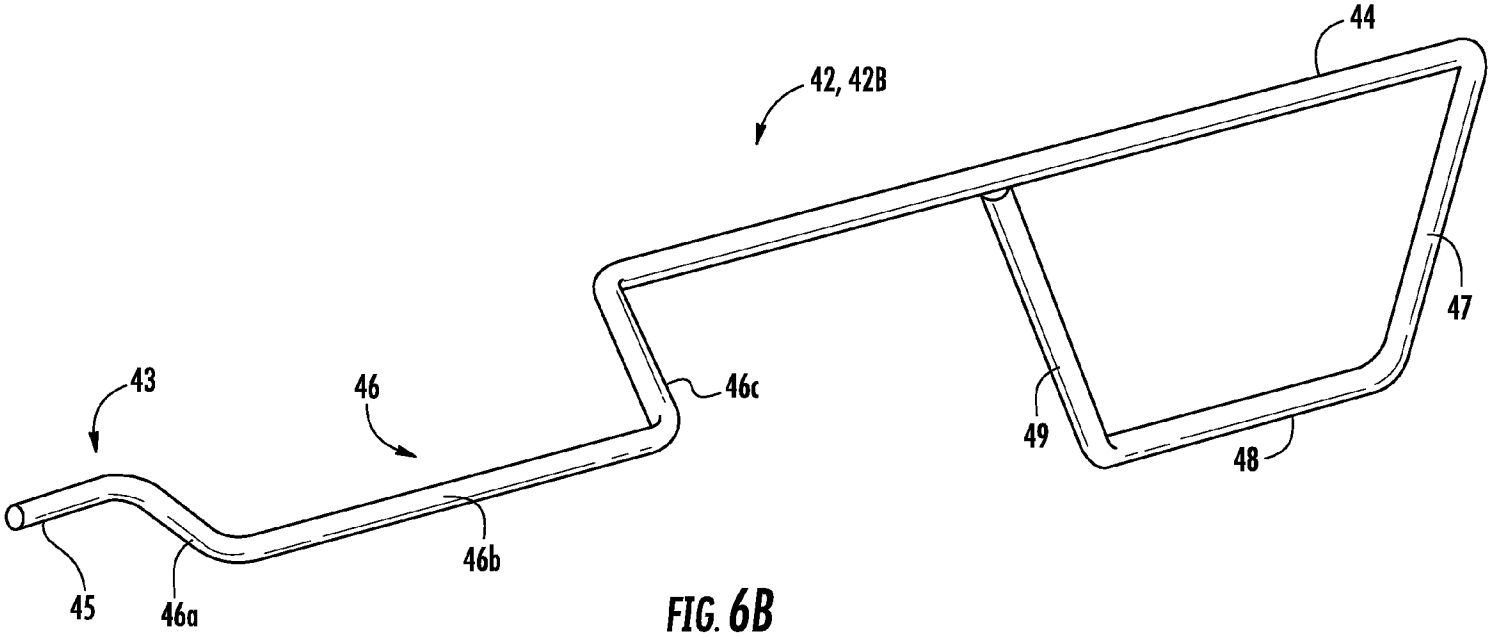
FIG. 6B is a perspective view of a stock according to the implementation of FIG. 1B.
Figures 7B, 8B, 9B:
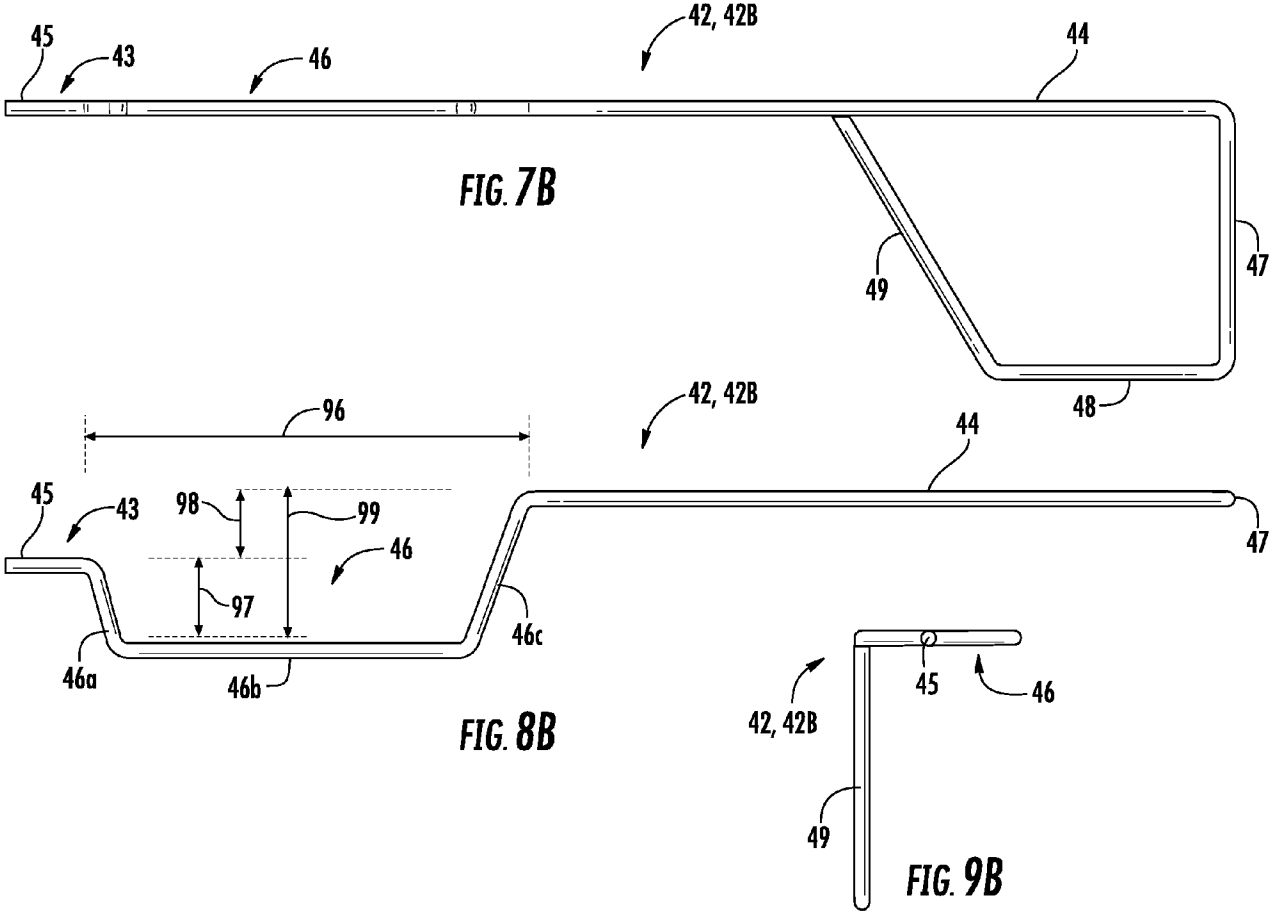
FIG. 7B is a side view of a stock according to the implementation of FIG. 1B.
FIG. 8B is a plan view of a stock according to the implementation of FIG. 1B.
FIG. 9B is front view of a stock according to the implementation of FIG. 1B.

Referring to FIGS. 6B, 7B, 8B, and 9B: FIG. 6B depicts a perspective view of a non-limiting implementation of a stock 42, FIG. 7B depicts a side view of a non-limiting implementation of a stock 42, FIG. 8B depicts a plan view of a non-limiting implementation of a stock 42, and FIG. 9B depicts a front view of a non-limiting implementation of a stock 42. Stock 42 may have a curvilinear or rectilinear wireform construction of a metal, alloy, plastic, composite, or other suitable material. Stock 42 may include a proximate portion 43, protrusion 46, and distal portion 44. Proximate portion 43 includes at least an engaging portion 45. In the stock 42 depicted as stock 42B, protrusion 46 is offset from the engaging portion 45 (offset 97) and may also be offset from distal portion 44 (offset 99) as shown. Protrusion 46 may include multiple angles separating sections, such as sections 46*a*, 46*b*, and 46*c*. Alternatively, protrusion 46 may have other angular, curved, or irregular shapes sufficient to achieve the goals of not obstructing the user's 20 dominant hand 22 and/or non-dominant hand 24 when firing and providing sufficient support to distal portion 44 against user's 20 shoulder or arm when firing. Distal portion 44: includes at least a column, shaft, spar, post, bar, or the like; typically is approximately parallel to the firing axis of firearm 30; and transfers energy from firing the firearm 30 to user's 20 shoulder or arm. Near the distal-most section of distal portion 44 a buttplate 47 operates to rest against the shoulder of user 20 when aiming and firing firearm 30. Buttplate 47 can be a simple wireform structure as shown, or it can be larger and include padding and/or a conformal elongated surface to be more comfortable against user's 20 shoulder. Distal portion 44 may also include sections 48 and 49, for example, to provide greater structural stability to buttplate 47 and transfer energy from the column portion of distal portion 44 when firing firearm 30.

In some implementations, protrusion 46 has a length 96, offset 97, offset 98, and offset 98 configured to avoid or limit contact with the dominant hand 22 and/or non-dominant hand 24 of user 20 when aiming and firing firearm 30 (e.g., as shown in FIGS. 1B and 8B). Length 96 is the overall length of protrusion 46 and may be about 10 to 30 cm, or preferably about 15 to 25 cm. Offset 97 is the offset between the axis of the engaging portion 45 (which is the same axis as the corresponding engaging recess 70 when fitted in block 62) and the outermost section of protrusion 46 (e.g., section 46*b* in FIG. 8B). Offset 97 may be about 1 to 10 cm, or preferably about 2 to 5 cm. Offset 98 is the offset between the axis of the engaging portion 45 and the axis of the column or main portion of distal portion 44, which is typically parallel to the firing axis (e.g., the barrel) of firearm 30. Offset 98 may be about 1 to 10 cm, or preferably about 2 to 4 cm. Offset 99 is the offset between the outermost section of protrusion 46 (section 46*b*) and the axis of the column or main portion of distal portion 44. Offset 99 may be about 2 to 15 cm, or preferably about 4 to 9 cm.

As with the discussion of FIG. 9A above, the protrusion 46 of stock 42B depicted in FIG. 9B may be positioned at different angles other than being orthogonal to the vertical plane of stock 42B (not shown). That is, protrusion 46 of stock 42B may be angled along various different planes other than the orthogonal plane shown, similar to the way tilted plane 105 shown in FIG. 9A can be positioned at numerous different angles with respect to vertical plane 100. The angle, shape, and position of protrusion 46 of any stock 42 may be determined based on one or more of the following: user 20 comfort; preventing or reducing contact with the dominant hand 22 and/or non-dominant hand 24; or preventing contact with firearm 30 to protrusion 46.

Figure 10A:
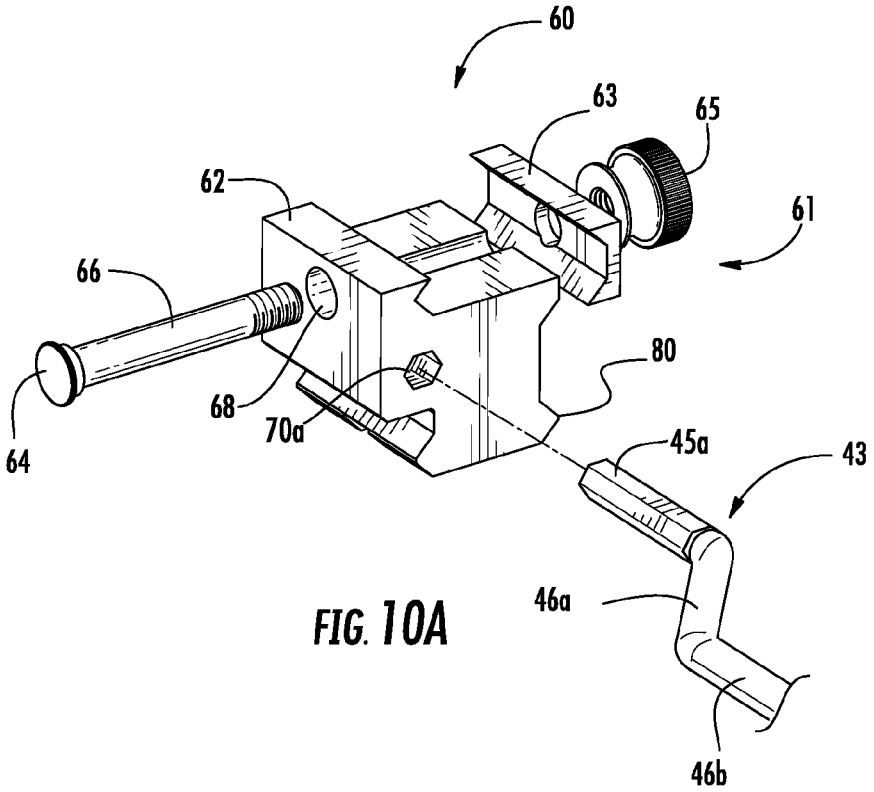
FIGS. 10A-10E are exploded perspective views of various non-limiting implementations of coupling a rail clamp assembly and stock together with an engaging portion and/or an engaging recess having different shapes, configurations, and/or mechanisms.
Figure 10B:
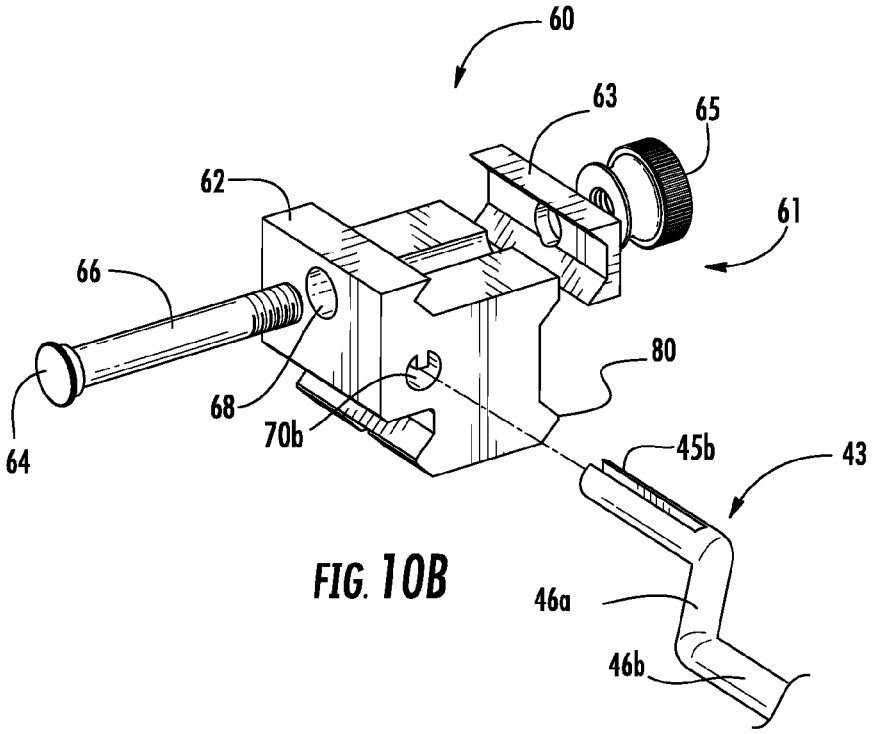
Figure 10C:
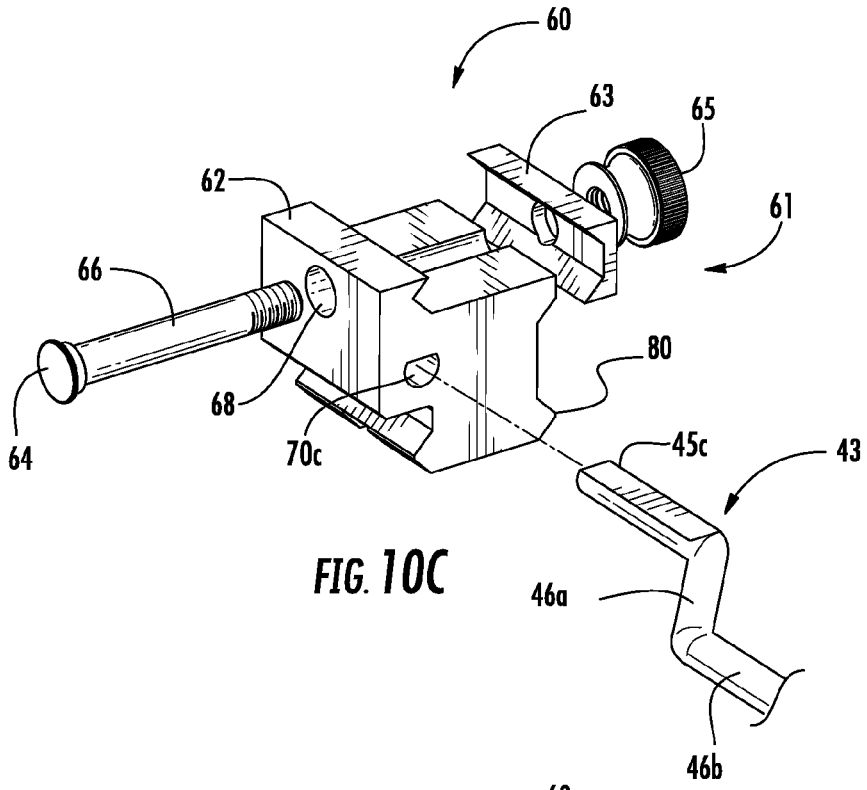
Figure 10D:
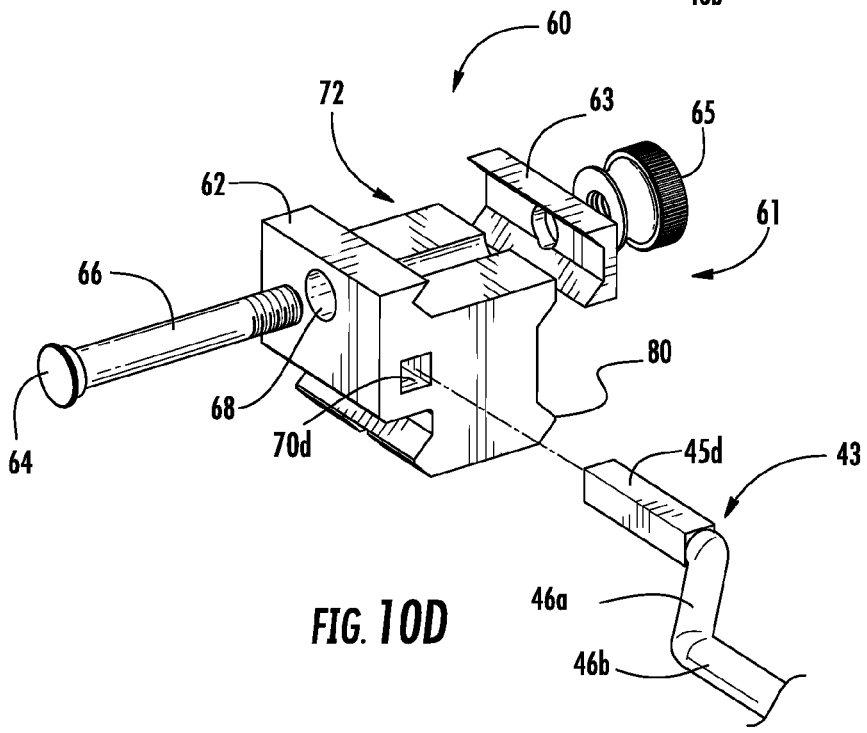

FIGS. 10A-10E depict exploded perspective views of various non-limiting implementations of coupling rail clamp assembly 60 and stock 42 together with engaging portion 45 and/or engaging recess 70 having different shapes, configurations, and/or mechanisms. FIG. 10A depicts a hexagonal shaped engaging portion 45*a* and engaging recess 70*a*. A hexagonal shaped engaging portion 45*a* and engaging recess 70*a* provide a keyed feature that prevents axial rotation of stock 42 and additionally may allow stock 42 to be inserted into engaging recess 70*a* in any one of six different rotated angular positions (located 60° apart because of the hexagonal shape). FIG. 10B depicts a slot keyed engaging portion 45*b* and engaging recess 70*b*, which prevents axial rotation of stock 42 and allows only one orientation for inserting engaging portion 45*b* into engaging recess 70*b*. FIG. 10C depicts a semi-circle keyed engaging portion 45*c* and engaging recess 70*c*, which prevents axial rotation of stock 42 and allows only one orientation for inserting engaging portion 45*c* into engaging recess 70*c*. FIG. 10D depicts a square shaped engaging portion 45*d* and engaging recess 70*d*. A square shaped engaging portion 45*d* and engaging recess 70*d* provide a keyed feature that prevents axial rotation of stock 42 and additionally may allow stock 42 to be inserted into engaging recess 70*d* in any one of four different rotated angular positions (located 90° apart because of the square shape). In some implementations a set screw (such as set screw 72 and threaded set recess 71 shown in FIGS. 2A, 3A and 5A) may be added to block 62 to help secure the engaging portion 45 into any of the engaging recesses 70*a*, 70*b*, 70*c*, and 70*d* shown in FIGS. 10A-10D.

Figure 10E:
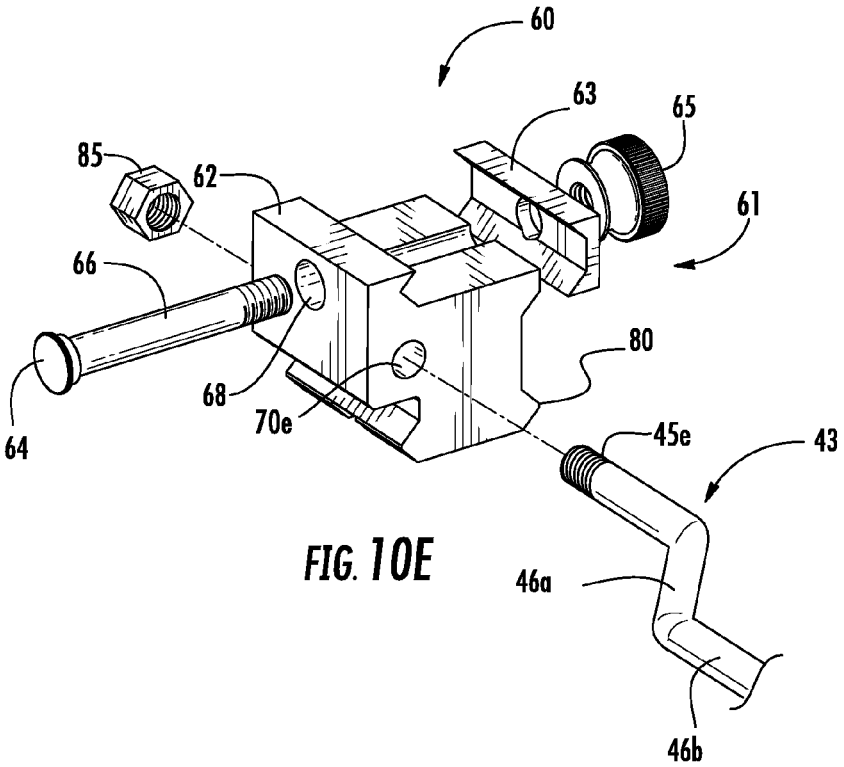
Figure 11:
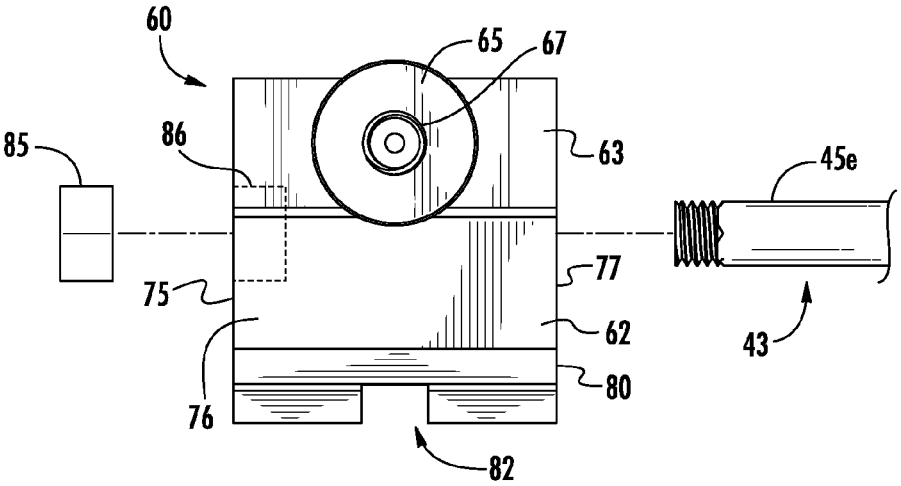
FIG. 11 is a partially exploded side view of the implementation of FIG. 10E.

FIG. 10E depicts an engaging portion 45*e* having a threaded end section that mates with threaded nut 85, which is housed in nut recess 86 such that nut 85 cannot rotate when coupled or mated with engaging portion 45*e*. FIG. 11 depicts a partially exploded side view of the implementation of FIG. 10E. Engaging portion 45*e* and nut 85 may be positioned or machined to cause stock 42 to stop rotating at a predetermined angular position by having nut 85 reach the end of the threads of engaging portion 45*e*. In some implementations, engaging portion 45 and engaging recess 70 may have a variety of different geometric (e.g., polygons having 3 to 40 sides), keyed, irregular, or other coupling shapes.

FIG. 12 depicts a front view of a non-limiting implementation of a firearm stock system 40. Stock 42 couples with rail clamp assembly 60, for example, using engaging portion 45 and engaging recess 70. Certain implementations of firearm stock system 40 permit stock 42 to couple with rail clamp assembly 60 at a variety of different angles (e.g., any angle within a maximum range or selected positions within a maximum range). Reference angle 110 in FIG. 12 can be considered an angle of 0°, reference angle 112 can be a maximum angle θ in a first direction, and reference angle 114 can be a maximum angle θ in a second direction. In some implementations, angle 112 can be about 10° to 90° away from angle 110, and angle 114 can be about 10° to 120° away from angle 110. In some implementations, these same angles can be utilized if rail clamp assembly 60 is rotated 180° to position 79 instead of position 78 shown in FIG. 12. Any angle θ between reference angle 112 and reference angle 114 may be a possible position depending on the shape of protrusion 46 of stock 42 based on the angle θ that protrusion 46 will prevent further rotation by contacting the firearm 30. Thus, stock 42B will have different angles θ than stock 42A or 42C because the protrusion 46 for each implementation is positioned differently.

Figure 14:
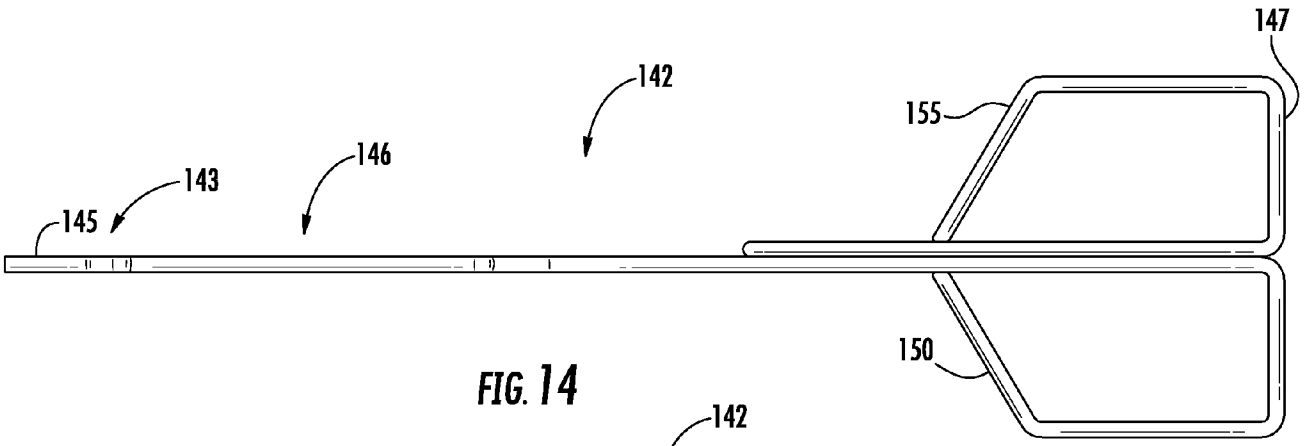
FIG. 14 is a side view of an ambidextrous stock.
Figure 15:
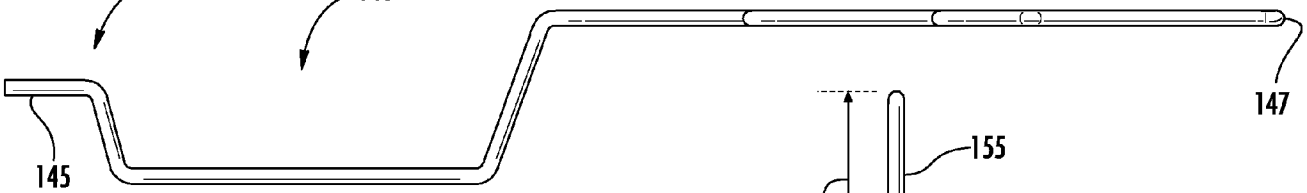
FIG. 15 is a plan view of an ambidextrous stock.
Figure 16:
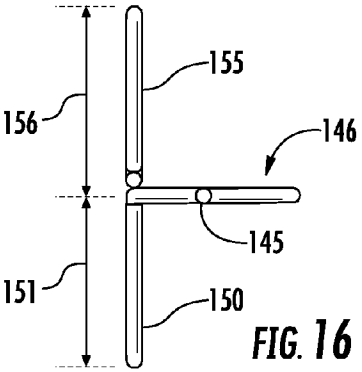
FIG. 16 is front view of an ambidextrous stock.

FIG. 13 depicts an exploded perspective view of a non-limiting implementation of a firearm stock system 40. Referring also to FIGS. 14-16, FIG. 14 depicts a side view of a non-limiting implementation of an ambidextrous stock 142, FIG. 15 depicts a plan view of a non-limiting implementation of an ambidextrous stock 142, and FIG. 16 depicts a front view of a non-limiting implementation of an ambidextrous stock 142. Ambidextrous stock 142 may be similar to stock 42, but have a modified distal portion 144 to allow a user 20 to rotate rail clamp assembly between position 78 and position 79 to alternate ambidextrous stock 142 between right-hand shooting and left-hand shooting positions with little or no difference in the way ambidextrous stock 142 feels against user's 20 shoulder when firing firearm 30. Namely, distal portion 144 may have a first half 150 and second half 155 positioned such that the main column of distal portion 144 is in the middle of the buttplate 147, which is formed from the rear-most sections of first half 150 and second half 155. The height 151 of first half 150 may be exactly or approximately the same as the height 156 of second half 155, thereby forming a single buttplate 147 from the two halves (150 and 155) with the central column of distal portion 144 meeting in the middle of buttplate 147. Thus, ambidextrous stock 142 may be configured to have a symmetrical shape when viewed from a left-side view or a right-side view (see FIG. 14), while the ambidextrous stock 142 has an asymmetrical shape when viewed from a plan, front, or rear view (see FIGS. 15 and 16). As explained above regarding buttplate 47, buttplate 147 may also be padded or conformal to increase comfort for the user 20. Thus, ambidextrous stock 142 can be alternated between left-handed shooting (as shown in FIG. 13) or right handed shooting while retaining the same basic shape and feel for the user 20 in either position. Ambidextrous stock 142 may also include engaging portion 145 (similar to engaging portion 45), proximate portion 143 (similar to proximate portion 43), and protrusion 146 (similar to protrusion 46).

Figure 17:
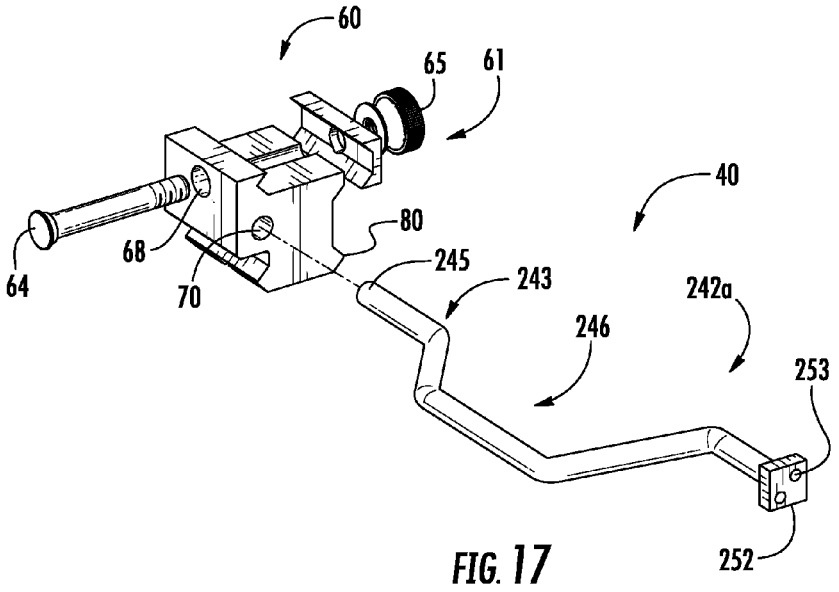
FIG. 17 is an exploded perspective view of a universal attachment stock.
Figure 18:
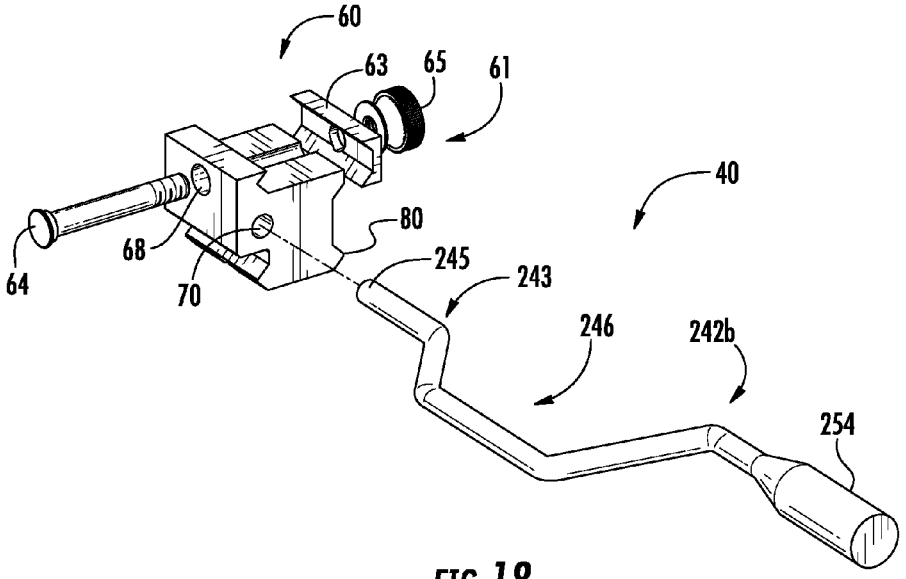
FIG. 18 is an exploded perspective view of a universal attachment stock.
Figure 19:
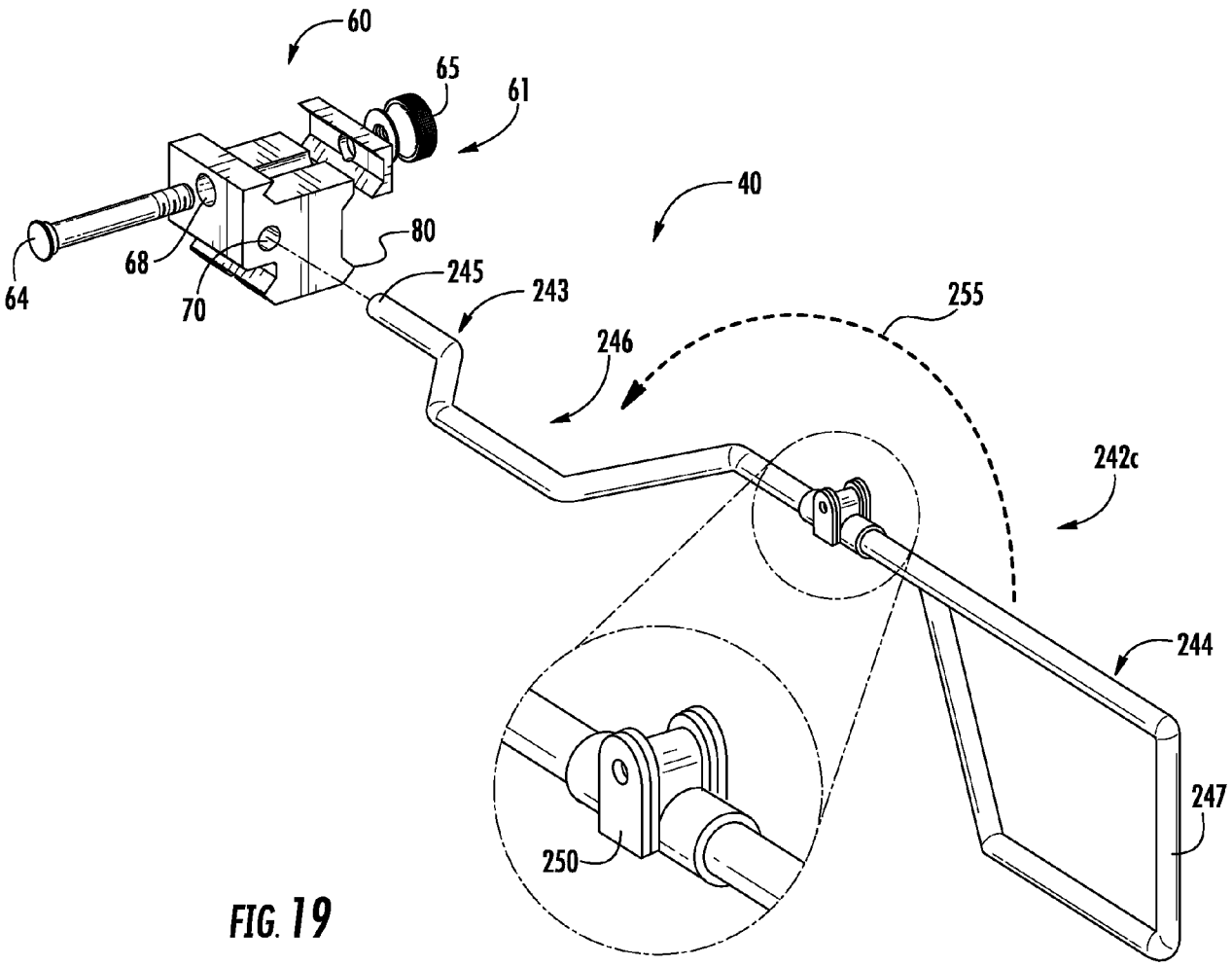
FIG. 19 is an exploded perspective view of a folding stock.

Referring to FIGS. 17-19, FIG. 17 depicts an exploded perspective view of a non-limiting implementation of a universal attachment stock 242*a*, FIG. 18 depicts an exploded perspective view of a non-limiting implementation of a universal attachment stock 242*b*, and FIG. 19 depicts an exploded perspective view of a non-limiting implementation of a folding stock 242*c*. Universal attachment stock 242*a* (in FIG. 17) includes a coupling means, such as fastener 252, which may also have one or more fastener elements 253 (e.g., holes, latches, clasps, etc.) assisting with removably coupling standardized or proprietary buttstocks (e.g., a removable buttstock, a collapsible buttstock, a stabilizing brace configured to couple to a forearm of a user, or a folding buttstock) to universal attachment stock 242*a*. Universal attachment stock 242*b* (in FIG. 18) includes a coupling means, such as post 254 (e.g., column, shaft, spar, bar, etc.), which may also have one or more fastener elements (not shown) (e.g., holes, latches, clasps, etc.) assisting with removably coupling standardized or proprietary buttstocks (e.g., a removable buttstock, a collapsible buttstock, a stabilizing brace configured to couple to a forearm of a user, or a folding buttstock) to universal attachment stock 242*b*. Folding stock 242*c* includes a hinge 250 located on distal portion 244 or on protrusion 246. Hinge 250 allows folding stock 242*c* to be folded in half to reduce the size of folding stock for ease of storage and/or handling firearm stock system 40 when attached to firearm 30. Hinge 250 may be a lockable hinge with a lock to prevent folding when the lock is engaged. Hinge 250 may allow folding stock 242*c* to fold in any direction that is not obstructed by the structure of folding stock 242*c* and firearm 30. Thus, folding motion 255 may be generally vertical (as shown) or the hinge 250 may be axially rotated or otherwise repositioned such that folding motion 255 may be generally horizontal (not shown) or at an angle other than vertical (not shown) that is not obstructed by the structure of folding stock 242*c* and firearm 30.

Further implementations are within the claims and discussed elsewhere in this document.

Specifications, Materials, Manufacture, System, and Installation

It will be understood that firearm stock system implementations are not limited to the specific assemblies, devices and components disclosed in this document, as virtually any assemblies, devices and components consistent with the intended operation of a firearm stock system implementation may be utilized. Accordingly, for example, although particular stocks, buttstocks, buttplates, accessory rail couplers, other couplers, fasteners, positionable adjustment mechanisms, and other assemblies, devices and components are disclosed, such may include any shape, size, style, type, model, version, class, measurement, concentration, material, weight, quantity, and/or the like consistent with the intended operation of a firearm stock system implementation. Implementations are not limited to uses of any specific assemblies, devices and components; provided that the assemblies, devices and components selected are consistent with the intended operation of a firearm stock system implementation.

Accordingly, the components defining any firearm stock system implementations may be formed of any of many different types of materials or combinations thereof that can readily be formed into shaped objects provided that the components selected are consistent with the intended operation of a firearm stock system implementation. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof.

Various firearm stock system implementations may be manufactured using conventional procedures as added to and improved upon through the procedures described here. Some components defining firearm stock system implementations may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g., a bolt, a nut, a screw, a nail, a rivet, a pin, and/or the like), wiring, any combination thereof, and/or the like for example, depending on, among other considerations, the particular material forming the components.

It will be understood that the assembly of firearm stock systems are not limited to the specific order of steps as disclosed in this document. Any steps or sequence of steps of the assembly of firearm stock systems indicated herein are given as examples of possible steps or sequence of steps and not as limitations, since various assembly processes and sequences of steps may be used to assemble firearm stock systems.

The invention claimed is:

1. A firearm stock system, comprising:

a stock having an engaging portion and a distal portion, the distal portion configured for engaging with a shoulder or an arm of a user: and a rail clamp assembly comprising:

a clamping member configured to releasably couple to an accessory rail of a firearm in a first position and a second position axially rotated approximately 180° from the first position, whereby the firearm stock system is configured for right-handed firing of the firearm in the first position and left-handed firing of the firearm in the second position;

a rail clamp body having an engaging member configured to couple with at least a portion of the engaging portion of the stock, thereby cantileveredly supporting the distal portion of the stock; and a secondary accessory rail.

2. The firearm stock system of claim 1, wherein the stock further comprises:

a protrusion portion positioned between the engaging portion and the distal portion of the stock, the protrusion portion having a length of 12 to 26 cm and being offset from a central axis of the engaging member by 2 to 6 cm.

3. The firearm stock system of claim 1, wherein:

the rail clamp assembly releasably couples the accessory rail of the firearm without directly touching any other portion of the firearm; and no portion of the stock directly touches the firearm.

4. The firearm stock system of claim 1, wherein the distal portion of the stock further comprises:

a buttplate having a top, bottom, and a length, the buttplate being configured to rest against a shoulder of a user when firing the firearm; and a column approximately parallel to a firing axis of the firearm, the column being coupled at approximately a midpoint between the top and bottom of the buttplate.

5. The firearm stock system of claim 1, wherein the engaging member comprises an engaging recess that extends through the rail clamp body from a first face to a second face of the rail clamp body, thereby permitting coupling of the stock through the first face in the first position and through the second face in the second position.

6. The firearm stock system of claim 1, wherein the stock comprises a folding buttstock.

7. A firearm stock system, comprising:

a stock having an engaging portion and a non-engaging portion, the non-engaging portion configured for engaging with a shoulder or an arm of a user: and a rail clamp assembly comprising:

a clamping member configured to releasably couple to an accessory rail of a firearm in a first position and a second position axially rotated approximately 180° from the first position, whereby the firearm stock system is configured for left-handed firing of the firearm in the first position and right-handed firing of the firearm in the second position;

a rail clamp body having an engaging recess configured to couple with the engaging portion of the stock, thereby cantileveredly supporting the non-engaging portion of the stock; and a secondary accessory rail.

8. The firearm stock system of claim 7, wherein the non-engaging portion of the stock has a length at least 15 times longer than the engaging portion of the stock.

9. The firearm stock system of claim 7, wherein no portion of the rail clamp assembly is positioned above a barrel of the firearm.

10. The firearm stock system of claim 7, wherein the stock has an asymmetrical shape along the longest axis of the stock when viewed from each of a plan view, right-side view, left-side view, front view, and rear view.

11. The firearm stock system of claim 7, wherein the stock is ambidextrous and configured for use in the first position and the second position.

12. The firearm stock system of claim 7, wherein the rail clamp assembly consists of no more than four machined pieces.

13. A firearm stock system, comprising:

a stock having an engaging portion and a distal portion, the distal portion configured for engaging with a shoulder or an arm of a user: and a rail clamp assembly comprising:

a clamping member configured to releasably couple to an accessory rail of a handgun in a first position and a second position axially rotated approximately 180° from the first position, whereby the firearm stock system is configured for left-handed firing of the handgun in the first position and right-handed firing of the handgun in the second position; and a rail clamp body having an engaging member configured to couple with at least a portion of the engaging portion of the stock, thereby cantileveredly supporting the distal portion of the stock;

wherein the stock is ambidextrous and configured for use in the first position and the second position.

14. The firearm stock system of claim 13, wherein the stock further comprises:

a protrusion portion positioned between the engaging portion and a distal portion of the stock, wherein an axis of the engaging portion, an axis of the protrusion portion, and an axis of the distal portion are each offset 2-8 cm from each other and are each approximately parallel to each other.

15. The firearm stock system of claim 13, wherein the distal portion of the stock is configured to couple to at least one of: a removable buttstock, a collapsible buttstock, a stabilizing brace configured to couple to a forearm of a user, or a folding buttstock.

16. The firearm stock system of claim 13, wherein the stock consists of a single piece of shaped metal having a curvilinear or rectilinear shape.

17. The firearm stock system of claim 13, wherein the engaging member comprises an engaging recess that is configured to couple with the engaging portion at at least two angles within an axial rotation of ±90° from a position orthogonal to a vertical axis of the firearm.

* * * * *